US006564479B1

(12) United States Patent
Vickers

(10) Patent No.: US 6,564,479 B1
(45) **Date of Patent: *May 20, 2003**

(54) PLASTIC MOLDBOARD PLOW

(75) Inventor: Robert V. Vickers, Chagrin Falls, OH (US)

(73) Assignee: The Louis Berkman Company, Steubenville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/596,749

(22) Filed: Jun. 19, 2000

Related U.S. Application Data

(63) Continuation of application No. 09/215,812, filed on Dec. 18, 1998, now Pat. No. 6,134,813.

(51) Int. Cl.[7] ..... E01H 5/06
(52) U.S. Cl. ..... 37/233; 37/196
(58) Field of Search ..... 37/233, 196, 232, 37/264, 266, 270, 466

(56) References Cited

U.S. PATENT DOCUMENTS

| | | | | |
|---|---|---|---|---|
| 3,432,947 A | | 3/1969 | Peitl | |
| 3,465,456 A | | 9/1969 | Meyer | |
| 3,994,081 A | | 11/1976 | Middleton | |
| 4,231,216 A | * | 11/1980 | Weber | 56/13.6 |
| 4,803,790 A | | 2/1989 | Ciula | |
| 4,844,195 A | * | 7/1989 | Deli et al. | 180/93.5 |
| 4,845,866 A | | 7/1989 | Ciula | |
| 5,088,215 A | | 2/1992 | Ciula | |
| 5,692,855 A | * | 12/1997 | Burton | 403/325 |

* cited by examiner

*Primary Examiner*—Thomas B. Will
*Assistant Examiner*—Meredith Petravick
(74) *Attorney, Agent, or Firm*—Fay, Sharpe, Fagan, Minnich & McKee

(57) ABSTRACT

A plow of the type used to clear snow and like debris from roadways and similar surfaces has a plastic moldboard secured to a rigid frame adapted to be mounted to a vehicle. The frame has at least one vertically extending brace member spaced from the moldboard to define a vertically extending gap between frame and moldboard. At least a portion of the gap is at least partially filled with a resilient material so that the moldboard is able to resiliently flex into the gap during heavy snow removal while preventing the gap from being filled with foreign matter including ice otherwise preventing desired flexing of the moldboard.

62 Claims, 15 Drawing Sheets

PLASTIC MOLDBOARD PLOW

This patent application is a continuation, of application Ser. No. 09/215,812 filed on Dec. 18, 1998, now U.S. Pat. No. 6,134,813, and incorporated herein by reference.

This invention relates generally to plows and more particularly to an improvement in snowplows and similar devices for cleaning snow and other debris from roadways and similar surfaces.

The invention is particularly applicable to a snowplow apparatus and construction, whereby an improved plow is provided and will be described with particular reference thereto. However, the invention may have broader applications and could be used for other applications such as agricultural purposes and the like.

INCORPORATION BY REFERENCE

Assignee's U.S. Pat. No. 4,845,866 issued Jul. 11, 1989 and U.S. Pat. No. 5,088,215 issued Feb. 18, 1992 are incorporated by reference herein and made a part hereof. The patents are incorporated by reference herein so that details of plow construction known in the art need not be restated herein. The patents incorporated by reference herein are background patents and do not form part of the present invention.

BACKGROUND OF THE INVENTION

A plow of the type used to remove snow from a roadway includes a blade which rolls the snow upwardly and then moves it transversely across the face of the blade. To accomplish this, the plow includes a moldboard having a curvilinear configuration which terminates in a lower plowing edge or a scraper blade. The scraper blade usually extends in a forward direction and, in effect, digs into the snow and forces the snow onto the curvilinear moldboard. The contour of the moldboard imports a rolling action to the upwardly moving snow and forces the snow transversely across the face of the moldboard and to the side of the plow.

Over the years, many different moldboard configurations of various curvilinear shapes have been experimented with to arrive at a shape which would insure smooth rolling and transverse movement of wet and powdery snow across the moldboard face. A curvilinear configuration, essentially arcuate in shape and extending in only one planar direction has proven an acceptable, widely used geometrical configuration for the moldboard.

A typical snowplow construction is to roll a mild steel carbon plate, typically of about ⅛", into an arcuate shape to form the moldboard. The framework, typically constructed from structural angle members, is then welded to the rear side of the moldboard to support and prevent the moldboard from fracturing when being hit by rock and other debris from the roadway while also providing a structure for the attachments necessary to operate the plow. Typical examples of such construction may be found by reference to U.S. Pat. Nos. 3,432,947 to Peitl and 3,465,456 to Meyer assigned to the current assignee.

From a consideration of plow weight, a steel moldboard is undesirable. It obviously places greater force requirements on the vehicle to which it is attached, and perhaps more importantly requires heavier plow attachments and larger lifting systems than what otherwise may be possible.

From an efficiency consideration, a number of attempts have been made to improve the efficiency of the steel moldboard in plows of the aforesaid type so as to better enhance the rolling motion and transverse movement of the snow across the face of the moldboard. Many of the approaches fundamentally involve a lowering of the coefficient of friction at the surface of the moldboard. For example, wax has long been used by snowplow operators on the moldboard. Moldboards have also been permanently coated with various substances. However, such coatings eventually fail when struck by rocks, stones and other debris from the roadway which impact the moldboard under significant forces.

A number of various materials having extremely low coefficients of friction exist in the art. In particular, ultra high molecular weight polyethylenes have been developed and applied in industrial application where sliding contact is encountered, such as, for example, in wear strips, slide plates, bearings and bushings. Until recently, considerations relating to the mechanical properties of such materials have ruled out the suitability of such materials for use as a moldboard in a snowplow application.

On the basis of weight and cost considerations alone, various types of plastics, other than ultra high molecular weight polyethylene, have been used as moldboards in snowplows. The plastic is preformed into the desired curvilinear shape and applied flush against the frame where it is drilled and fastened in place in the same manner that the steel moldboard is conventionally applied to the frame. Depending upon the properties of the plastic and its durability, plastic moldboards have met with limited success.

The snow plow art was significantly advanced when a high molecular weight, polyethylene material was used as a moldboard to produce a durable, lightweight and significantly improved snowplow as disclosed in U.S. Pat. No. 4,803,790 (and its parent U.S. Pat. No. 4,845,866) to Ciula incorporated herein by reference. The plow disclosed in the '790 patent comprises a conventional frame which includes top and bottom longitudinally extending mounting members approximately equal to the length of the plow blade and a plurality of vertically extending, transversely spaced brace members. Each brace member is secured at one end to the top mounting member and at its opposite end to the bottom mounting member and has inwardly curved, forward edge surfaces extending between the top and bottom mounting members. A generally rectangular and inwardly curved polyethylene moldboard of high molecular weight is attached by threaded fasteners to the top and bottom mounting members in a somewhat flexed or prestressed manner. The rearward surface of the attached moldboard is spaced away from the forward edge surface of the brace members a fixed distance to define a gap therebetween. This gap distance is normally sufficient to prevent contact therebetween during operation of the plow while permitting brace contact during excessive debris impact. More particularly, the moldboard resiliently flexes into and out of the gap during heavy or wet snow removal and this flexing enhances the transverse and rolling movement of the snow over the face of the moldboard. Yet the frame/moldboard mounting arrangement provides brace support for the moldboard when the moldboard is impacted with heavy debris to prevent moldboard fracture. For these reasons, the '807 patent is a significant advance in the art.

This arrangement was improved upon in U.S. Pat. No. 5,088,215 to Ciula, also incorporated herein by reference. In the '215 patent, the high molecular weight, polyethylene moldboard was molded with a desired curvature and the top and bottom molding mounting members changed to allow the moldboard to be snapped into or onto the frame and secured by fasteners in a conventional manner. While the '215 patent improved the frame mounting arrangement, the gap between the moldboard and the brace members is maintained so that the moldboard retains its enhanced snow removal characteristics.

In summary, both designs have achieved considerable success not only because of weight reduction and cost considerations, but also because of the enhanced operation of the moldboard attributed to the characteristics of the polyethylene material and the utilization of the material's ability to spring or flex into the gap designed mounting arrangement.

Snow plows are typically used in hostile environments and are subjected to cold temperatures, moisture, freezing rain, ice, salt, and severe impacts against fixed protrusions such as curbs and from rocks and debris from the roadway. During continued or protracted operation of the plow, debris from the road can lodge itself into the gaps between the moldboard and brace members. If the operator does not take time to periodically clean the gaps, they can become eventually full with solid debris with the result that the resilient mounting of the moldboard onto the frame, provided by the gap, is lost or diminished. More significantly, plow operating temperatures encompass such a wide temperature range, that water collected in the gap can freeze into ice or create ice pockets in the gap. In such instances the gap designed into the moldboard/frame mounting arrangement is lost or drastically reduced. While the moldboard still has superior snow removal characteristics attributed to its low co-efficient of friction, the enhanced ability of the moldboard to transversely move and roll the snow across the face of the plow is diminished.

SUMMARY OF THE INVENTION

Accordingly, it is a principal object of the invention to provide a mounting arrangement for a plastic moldboard in a plow which allows the moldboard to achieve its designed resilient deflection no matter what operating conditions the plow is subjected to.

This object along with other features of the invention is achieved in a vehicular plow of the type used to clear snow and like debris from roadways and similar surfaces which includes a plastic moldboard and a rigid frame secured to the vehicle on one side thereof and to which the moldboard is assembled on the opposite side thereof. The frame has at least one vertically extending brace member spaced from the moldboard over a portion of its length to define a vertically extending gap therebetween and a resilient material at least partially fills at least a portion of the gap whereby the moldboard is able to resiliently flex even if foreign material or foreign matter, which includes formation of ice or ice pockets in the gap as well as solid debris from the road, accumulates in that portion of the gap not filled by the resilient material.

In accordance with another aspect of the invention, the frame includes top and bottom longitudinally extending mounting members vertically spaced from one another by a plurality of the brace members transversely spaced along the length of the mounting members with the moldboard connected to the mounting members when assembled into the frame. The moldboard and the confronting portion of each brace member are inwardly curved to define the gap as an arcuate gap which may or may not be designed uniform throughout its length. The resilient material substantially fills each gap thereby preventing foreign matter from accumulating and stopping the moldboard from resiliently deflecting into the gap.

In accordance with a specific aspect of the invention the brace members are structural angle members, each brace being orientated to have a V-shaped cross-sectional configuration with the edges of the legs forming the V-shape being inwardly curved so that the leg edges and the back of the moldboard define the arcuate gap. The resilient material, when the moldboard is assembled in the frame, is interposed between each of the leg edges of each brace and the back of the moldboard to substantially or partially fill the gap by any number of resilient mass configurations, including, but not limited to:

a) the resilient material comprising a block of material positioned within the V of each brace member and extending beyond the leg edges to substantially close the gap; or b) the block in (a) with a longitudinally extending opening therein, the opening being distended when the block of resilient material is compressed; or c) the block in (a) or (b) having a cross-sectional configuration substantially in the shape of a V so that the block of material nests within the V-shaped configuration of a brace member; or d) the resilient material is a vertically extending strip of resilient material interposed between each leg edge and the moldboard; or e) the strip of (d) having a thickness approximately equal to the gap and adhesively secured to the moldboard; or f) the strip of (e) secured to the moldboard by means of a cushioned, double-faced adhesive tape; or g) the strip of (d) having a groove formed in one of its side, the bottom of the groove adapted to contact a leg edge and the sides of the groove adapted to contact the sides of a leg of the brace member; or h) the resilient material is in the form a retrofit insert strip having an especially configured groove permitting the insert to be snapped into groove seating with a leg of a brace member after the moldboard has been assembled into the frame; or i) the insert of (h) wherein the strip is triangular in cross-section configuration with a groove formed on a first side of the strip adjacent a second side of the strip which is in contact with the moldboard so that the first and second sides form an apex of the triangle whereby the insert is wedged into a groove seating position between the moldboard and a leg of a brace member.

In accordance with another feature of the invention, the moldboard is mounted to the mounting members by fasteners and the resilient material extends a distance substantially equal to the gap (or even greater than the gap) so that the resilient material contacts the moldboard (or is even slightly compressed) as the fasteners are tightened to assure that no gap is present when the moldboard is assembled in the frame whereby any accumulation of foreign matter in the gap is prevented while maintaining a resilient mounting of the moldboard to the frame.

In accordance with another feature of the invention, the moldboard is mounted to the mounting members by fasteners and the resilient material extends a distance less than the gap when the moldboard is assembled in the frame whereby any accumulation of foreign matter in the open space of the partially filled gap does not prevent the moldboard from resiliently deflecting into the gap.

It is yet another feature of the invention to provide a method of assembling a plow comprising the steps of a) providing a polyethylene moldboard; b) forming a frame by securing on one side of top and bottom longitudinally extending mounting members a plurality of vertically extending brace members; c) securing the moldboard to the opposite side of the mounting members and in the process thereof forming a gap between confronting surfaces of the brace members and the moldboard; and d) affixing a resilient material to the moldboard and/or the brace members before or after assembly of the moldboard into the frame to at least fill a portion of the gap.

It is thus an object of the invention to provide a plow with a plastic moldboard assembled in a frame in a resilient manner which is able to resiliently deflect notwithstanding the accumulation of foreign material, including ice build up, between the moldboard and the frame.

It is another object of the invention to provide a plow with a plastic moldboard assembled in a frame in a resilient manner which prevents accumulation of foreign matter between the moldboard and the frame while allowing the moldboard to achieve designed resilient deflection.

An important object of the invention is to provide apparatus and method for retrofitting existing plows having plastic moldboards resiliently mounted in a frame with a mounting arrangement which positively assures that the moldboards resiliently deflect notwithstanding adverse conditions resulting from the harsh operating environment of a snow plow.

Yet another object of the invention to provide a plow with a plastic moldboard having any of the characteristics described above which can be easily assembled or repaired if necessary.

Still yet another object of the invention is to provide a plow with a plastic moldboard having any of the characteristics described above which is relatively inexpensive.

Yet another object of the invention is to provide a snowplow frame mounting arrangement for a high density, polyethylene moldboard which positively insures designed flexure of the moldboard notwithstanding any adverse effects attributed to the snowplow's operating environment.

These and other objects and advantages of the present invention will become apparent from the following Detailed Description of the Invention taken in conjunction with the accompanying drawings which are described below.

BRIEF DESCRIPTION OF THE DRAWINGS

The invention may take physical form in certain parts and arrangements of parts, preferred embodiments of which will be described in detail and illustrated in the accompanying drawings which form a part hereof and wherein.

DETAILED DESCRIPTION OF THE INVENTION

Figure 1:
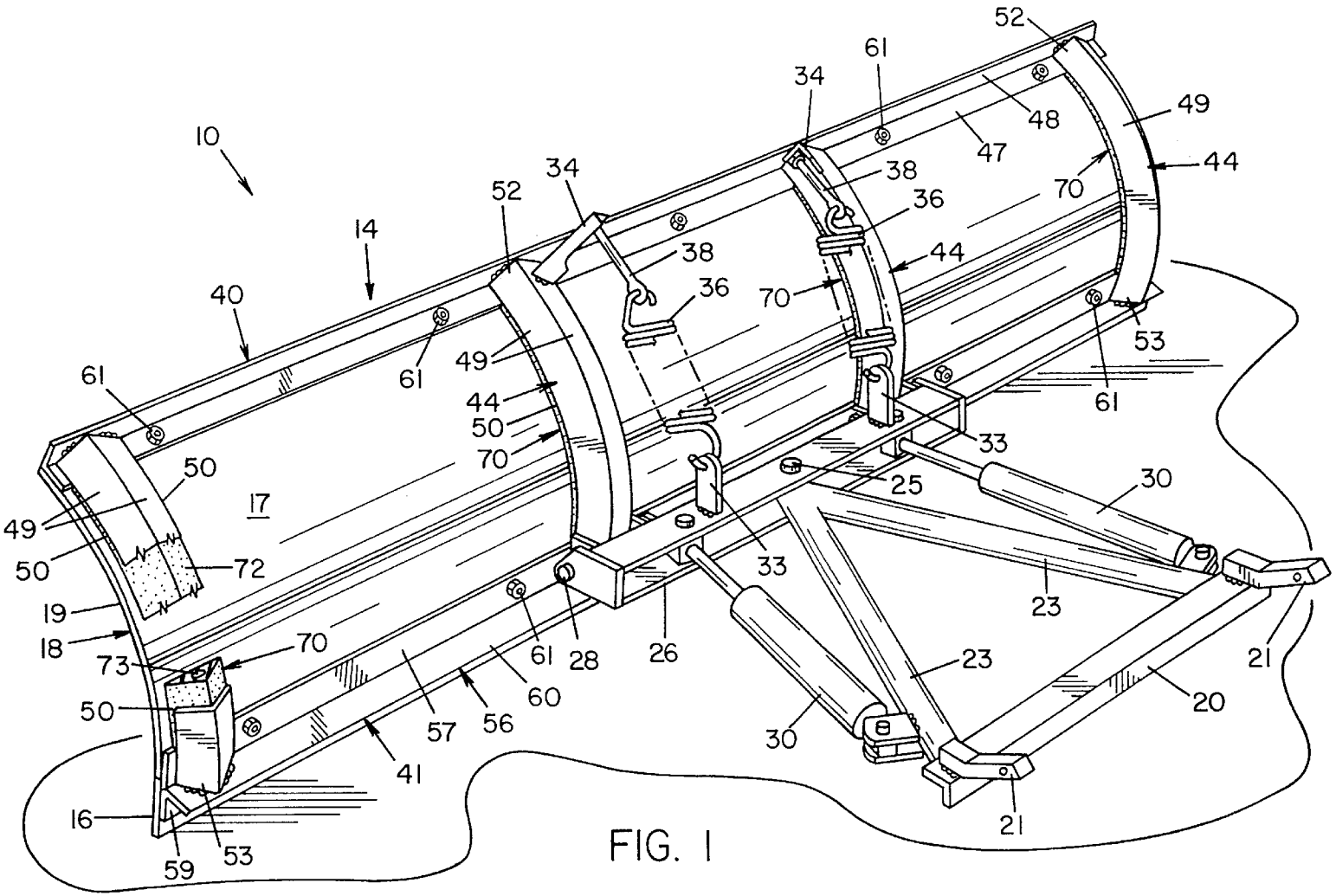
FIG. 1 is a perspective, rear elevation view of a snow plow with certain portions broken away for illustration purposes of a type typically mounted to a pick-up truck or like vehicle, i.e., a "small" plow.

Referring now to the drawings wherein the showings are for the purpose of illustrating preferred embodiments of the invention only and not for the purpose of limiting the same, there is shown in FIG. 1 a plow 10 of the a type suitable for application to pick-up trucks, 4×4 vehicles and the like for light snow removal operations such as encountered in plowing driveways, parking lots, etc. and is typically about 78 inches in length. Larger, heavy duty plows suitable for use by municipalities and governmental agencies for removing snow and debris from roadways and typically have a length of 90 inches and may employ a different frame mounting than that illustrated. It is to be understood, and those skilled in the art will readily understand, that the invention is applicable to large plow applications as well as the small plow applications illustrated herein.

Figure 2:
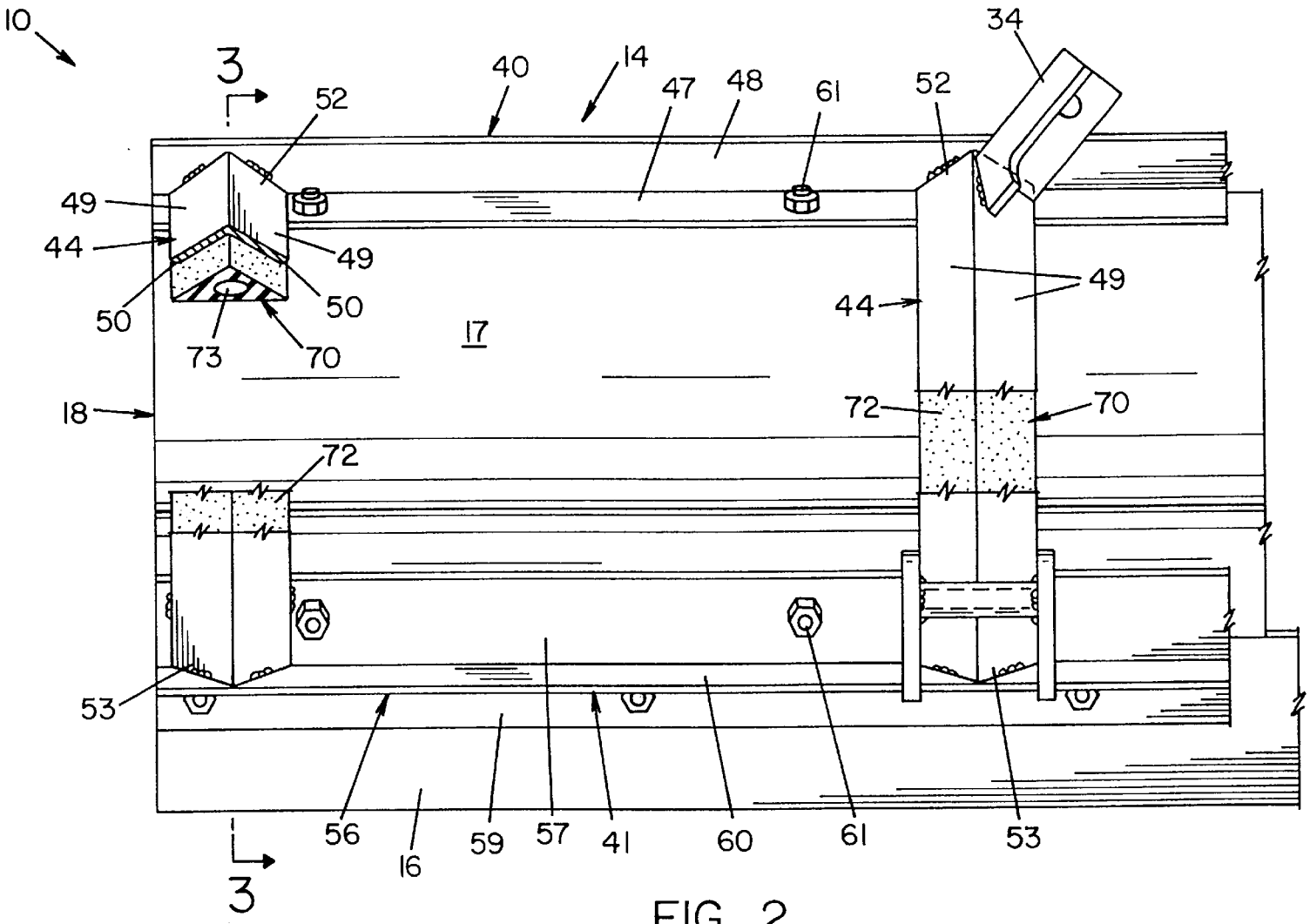
FIG. 2 is a rear elevation view of a portion of the snow plow illustrated in FIG. 1 with portions broken away for illustration purposes.
Figure 3:
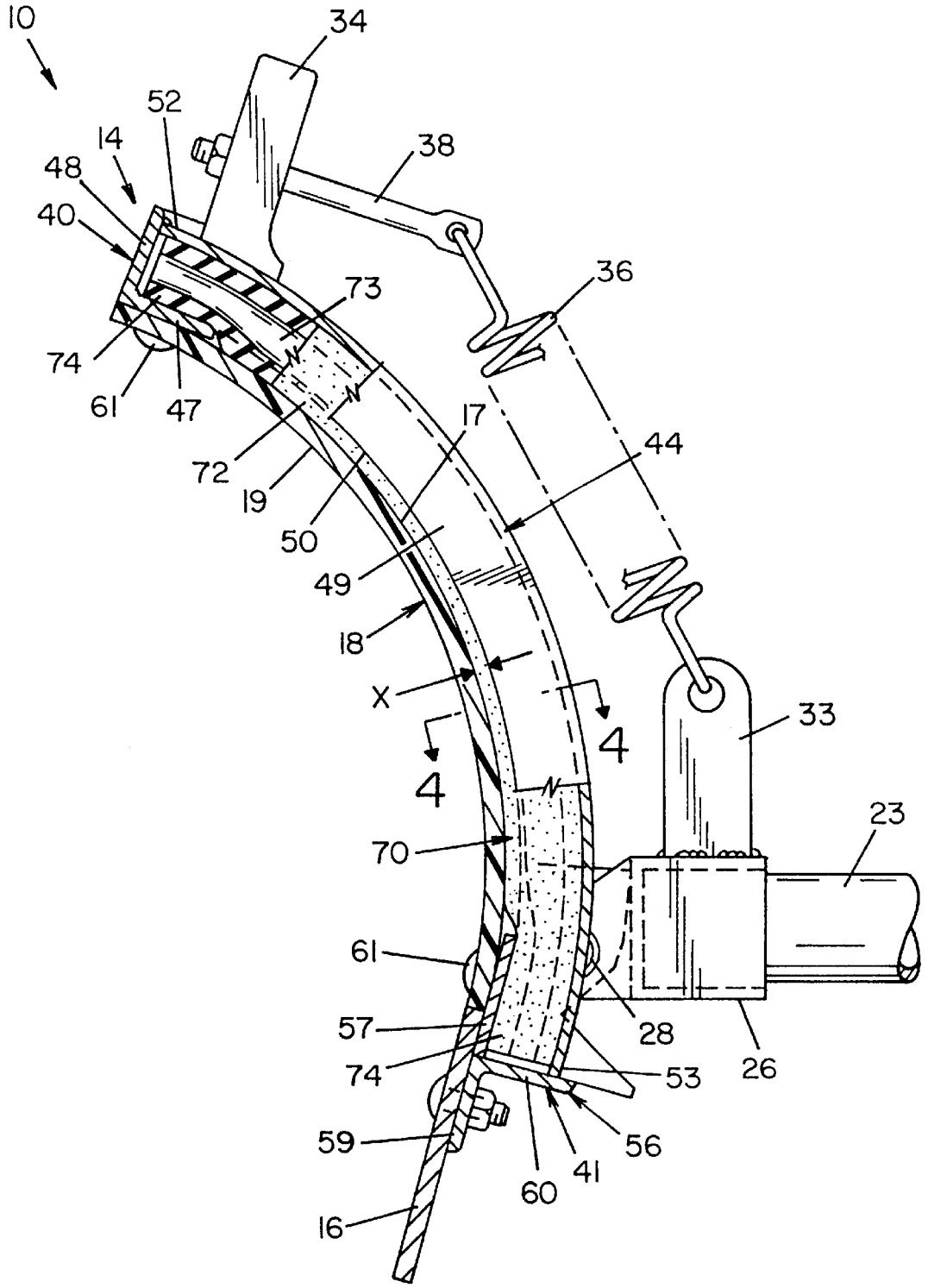
FIG. 3 is an end view of the plow taken along lines 3—3 of FIG. 2 with certain portions broken away to show one embodiment of the resilient material used in the invention.

Referring now to FIGS. 1, 2 and 3, plow 10 generally comprises a longitudinally extending structural frame 14, a scraper blade 16 attached to the bottom of the frame 14 and an inwardly curved moldboard 18. Inwardly curved moldboard 18 has a front face surface 19 and a rearward surface 17 adjacent frame 14. For consistency in terminology and as used herein, "scraper blade" means the replaceable, lower edge portion of the plow, while "blade" means the inwardly curved front face 19 of moldboard 18 and the scraper blade 16. Plow 10 means the frame 14, moldboard 18 and scraper blade 16. "Assembled position" means the relationship between frame 14, moldboard 18 and scraper blade 16 when plow 10 is assembled and mounted to the vehicle but is not operating to remove snow and the like, i.e., an at rest position. "Flex" means a resilient rearward movement of moldboard 18 relative to frame 14.

Secured or attached to frame 14 are conventional plow accessories which are necessary for operation of plow 10. The accessories include a support crossover arm 20 having journals 21 which are mounted to a vehicle (not shown). Extending from support crossover arm 20 are struts 23 which are pivoted as at 25 to a box-like structure 26. Box structure 26 is pivotally mounted to the bottom portion of frame 14 by a pin connection 28. Pin connection 28 permits plow 10 to rotate in a forward or rearward direction. Cylinders 30 mounted on each side of struts 23 permit angling of the plow 10 about pivot 25 so that the attitude of plow 10 relative to the vehicle can be skewed to discharge snow from one side or the other of plow 10.

A first trunnion 33 secured to box structure 26 and a second trunnion 34 secured to the upper end of frame 14 provide the mounting for a spring 36 which maintains plow 10 in an upright position. When scraper blade 16 engages an obstacle in the roadway, plow 10 pivots about pins 28 against the action of springs 36 which return plow 10 to its normal position after passing over the obstacle. The tension of springs 36 is adjusted in a conventional manner by adjustable arms 38 threaded to second trunnion 34.

The accessories described are conventional in the plow art and do not, per se, form part of the invention. However, it is to be recognized that the light weight of moldboard 18 will permit the accessories as well as frame 14 to be designed so as to reduce their weight and cost when compared to the design of such item used with conventional steel moldboards.

Referring still to FIGS. 1, 2 and 3, frame 14 is a somewhat conventional frame similar to that used on steel snow plows. The invention is not limited to a specific frame design. Generally, frame 14 comprises a longitudinally extending top mounting member 40 which extends the length of the plow, a bottom mounting member 41 which similarly extends the length of the plow and a plurality of transversely spaced, inwardly curved braces 44 which extend between and are secured to top and bottom mounting members 40, 41. In practice, top mounting member 40 is a structural angle having a mounting leg 47 at right angles to a generally radially extending leg 48. Braces 44, similarly, are structural angles which are orientated, as shown in the drawings, to have a V-shaped cross-sectional configuration. The legs 49 of the "V" terminate at inwardly curved forward edge surfaces 50 similar to the curvature of inwardly curved moldboard 18. Preferably, forward edge surfaces 50 of braces 44 are arcuate and have a predetermined radius of curvature sized relative to that of moldboard 18. While a number of frames can be used, there must be a brace behind and spaced from rearward surface 17 of moldboard 18.

Each brace 44 has a top end 52 which preferably is cut along a radial line coincident with the center of the radius of curvature of forward edge surfaces 50. Mounted flush against top end 52 and welded thereto is radially extending leg 48 of top mounting member 40 and this co-planar line contact assures the position of mounting leg 47 relative to moldboard 18. That is, by changing the angular relationship of top end 52 of brace 44 relative to the radius of curvature of forward edge surfaces 50, the relationship between moldboard 18 and forward edge surfaces 50 can be varied. Alternatively, jigs or fixtures can be used to establish a relationship between moldboard 18 and frame 14. Similarly, the bottom end 53 of each brace 44 is likewise cut, preferably on a radial plane coincident with the center of the radius of curvature of forward edge surfaces 50. Bottom mounting member 41 comprises, in the preferred embodiment, a bottom structural angle 56 and a flat bottom mounting plate 57. Bottom angle 56 has a mounting leg 59 and at right angles thereto a radially extending leg 60. Bottom end 53 of brace 44 abuts against radially extending leg 60 similar to that described for top mounting member 40. Secured to the forward edge surfaces 50 of each brace 44 and adjacent each brace's bottom end 53 is a flat mounting plate 57 which abuts against radially extending leg 60 preferably so that mounting leg 59 of bottom angle 56 and mounting plate 57 are substantially or somewhat co-planar.

Frame 14 is constructed by accurately cutting the structural angles, bending braces 44 to the proper degree of curvature and then utilizing conventional jigs and fixtures to hold the members in their proper relationship while they are fixedly welded to one another. Again, frame 14 as shown in FIGS. 1, 2 and 3 is conventional. Alternatively, a frame of the type illustrated in U.S. Pat. No. 5,088,215, incorporated herein by reference can be used. The general configuration of all the frames will be somewhat similar. There will be preferably at least four (4) braces 44 mounted to at least one and preferably two (top and bottom) mounting plates. The cross-sectional shapes of the mounting plates and braces can change.

Moldboard 18 is preferably formed from an ultra high molecular weight (UHMW) polyethylene plastic and is typically about ⅜" thick. An acceptable UHMW plastic marketed under the registered trademark HOSTALEN GUR412 LS and GUR422 is available from American Hoechst Corporation. The UHMW polyethylene material has an exceptionally low coefficient of friction, relative high resistance to abrasion and adequate impact and yield strengths to function in a snow plow environment. In the preferred embodiment, the material is initially rolled from a flat plate sheet into the arcuate configuration as shown in the drawings. It will not retain that shape in a free standing state over a period of time. It is for this reason that its industrial use has been limited to liners and wear plates where it can be adequately supported. The frame illustrated in FIGS. 1–3 or alternatively the frame illustrated in U.S. Pat. No. 5,088,215 supports moldboard in its desired inwardly curved configuration. In frame 14 illustrated in FIGS. 1–3, fasteners 61, preferably having square shanks fitting through square holes in moldboard 18, mount moldboard 18 to top mounting leg 47 and bottom mounting plate 57. Significantly braces 44 provide curvature support to moldboard 18 when the plow is in use permitting the moldboard to flex or spring during operation to enhance the operation of the plow.

In accordance with the teachings of U.S. Pat. Nos. 4,803,790; 4,845,866 and 5,088,215, moldboard flexing is accomplished by the provision of a vertically extending space or gap existing between forward edge surface 50 of braces 44 and rearward surface 17 of moldboard 18 when moldboard is an assembled or at rest position within frame 14, i.e., plow 10 is not in operation. This vertically extending gap, defined and shown as "X" in the drawings is not necessarily uniform throughout its vertical length. In fact, gap X is purposely designed, in the preferred embodiment, to vary from a minimum distance near the top portion of moldboard 18 to a maximum distance near the bottom portion of moldboard 18, i.e., resembling half of a crescent. By varying the gap, the spring or flex of the moldboard can be controlled over various areas of the moldboard resulting in a further enhanced action of the moldboard rolling and translating the snow across forward face 19.

Figures 21, 22:
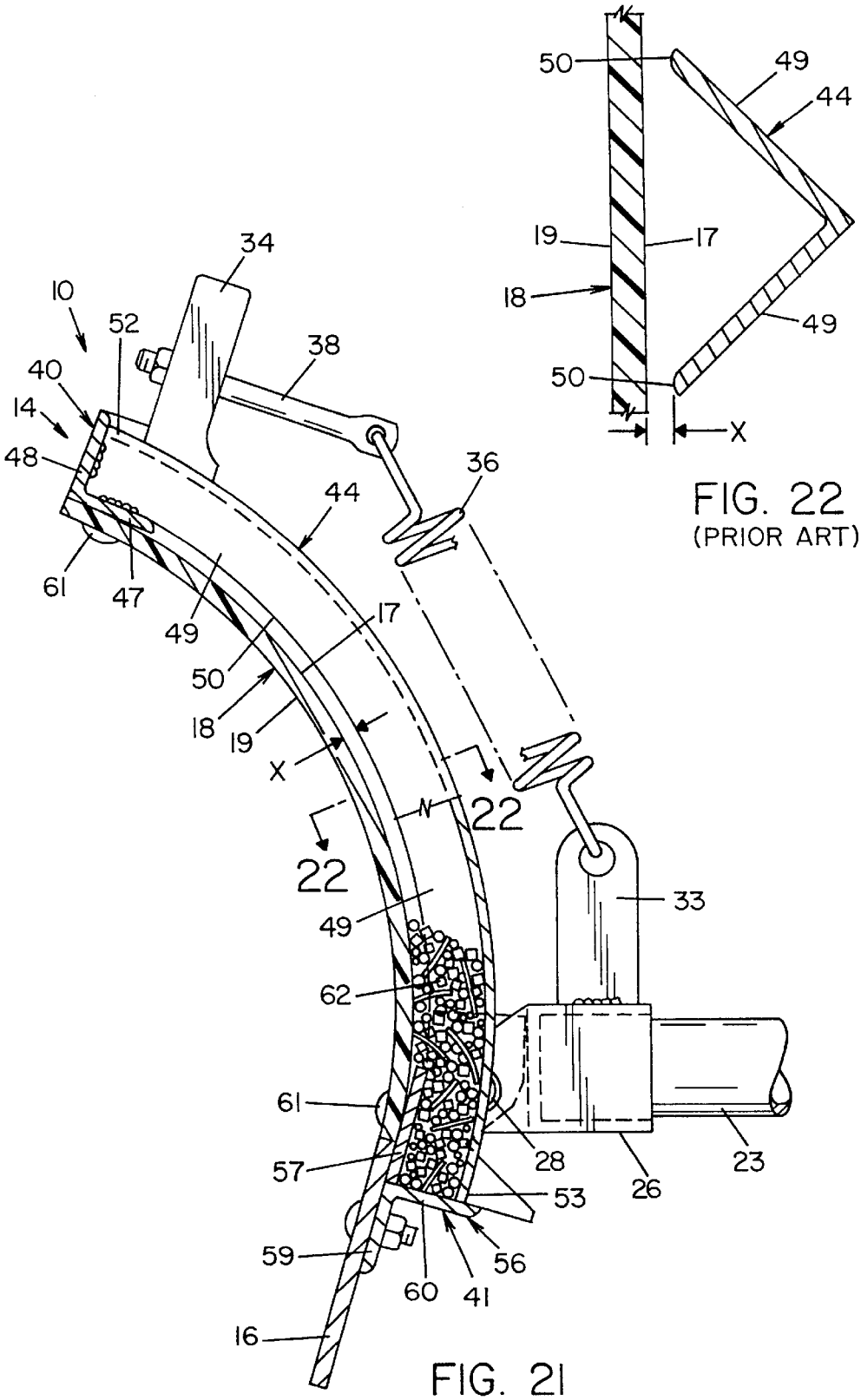
FIG. 21 (PRIOR ART)
FIG. 22 (PRIOR ART)
FIG. 21 is prior art and is a view similar to FIGS. 3, 7, 11, 13 and 18.
FIG. 22 is prior art and is a view similar to FIGS. 4, 4A, 8, 12, 15 and 17 and is taken along lines 22—22 of FIG. 21.

Everything described thus far is conventional and is illustrated in FIGS. 21 and 22 which show the described prior art arrangement. The vertically extending gap which is the space between moldboard 18 and the confronting portion of brace 44 is best shown in FIG. 21 as the distance X. More specifically as shown in the cross-sectioned view of FIG. 22, gap X is the distance between rearward surface 17 of moldboard 18 and curved forward edge surface 50 of leg 49 of brace 44. Again, gap X is taken up by flexure of moldboard 18. Foreign matter indicated by reference numeral 62 in FIG. 21 accumulates in and fills gap X. The material will wedge its way into and between legs 49 of brace 44. This foreign matter is not only road debris but also ice formations or ice pockets occurring when the plow is operated in its harsh environment. The foreign matter prevents desired deflection or only allows partial desired deflection of moldboard 18. Plow 10 will still function and it will still function in a manner superior to plows equipped with conventional steel blades because of the low co-efficient of friction of polyethylene moldboard 18. However, the flex and spring built into the design by gap X is defeated or diminished.

Referring now to FIGS. 1–6, the invention includes the placement of a solid mass of resilient material 70 between brace 44 and moldboard 18 to occupy at least a portion of gap X.

As used herein and in the claims "resilient material" means any solid, elastic material which retains some degree of elasticity (an ability to be stretched under force and retract to original size when the force is released) at the temperatures that plow 10 is typically exposed to. Resilient material includes natural elastic materials, thermoset materials and thermoplastics, particularly those characterized as natural or synthetic elastomers or containing natural or synthetic elastomers as components, polymers or compounds thereof including but not limited to natural rubber, fluoroelastomers, polyurethane elastomers, styrene-butadiene, cis-1,4-Polybutadiene, cis-1,4-Polyisoprene, butyl rubber, ethylenepropylene polymers, ethylene-butylene polymers, neoprene, nitrile rubber, silicone rubber, polysulfide rubbers, polyacrylate rubbers and thermoplastic polyolefins. Resilient material also includes liquid foams and sprays which solidify into flexible, resilient solid material when dried or cured, such as polymeric foams and in particular one or two component, flexible polyurethane foams which are well suited for retrofit, in situ applications. In the preferred embodiment, resilient material is a thermoplastic elastomer sold under the brand name Santoprene 101-64 available from Mile Rubber & Packaging Co. This material has a compression set of about 23% at 77 degrees F and an elongation percentage (break) of about 400%. Durometer hardness is about 50 (contemplated hardness is within range of 20–80 and preferably within 40–60) and is non-brittle at low temperature.

Figure 4:
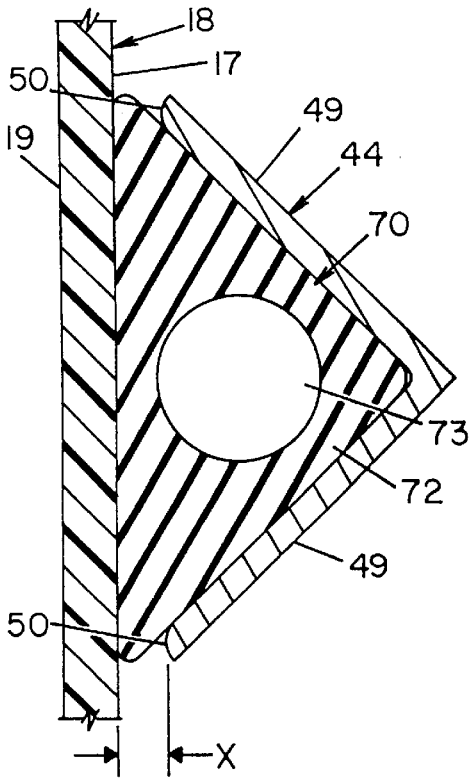
FIG. 4 is a cross-sectioned view of the moldboard and the brace member taken along lines 4—4 of FIG. 3.
Figure 5:
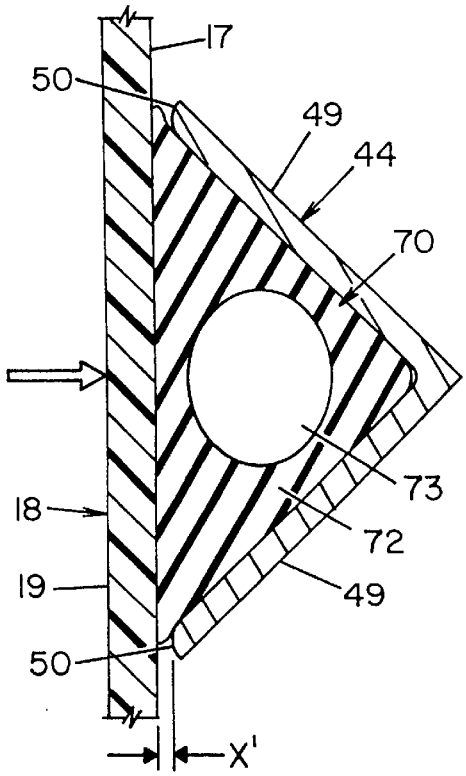
FIG. 5 is a cross-sectioned view similar to FIG. 4 but showing the position of the molding material when the moldboard is deflected.
Figure 6:
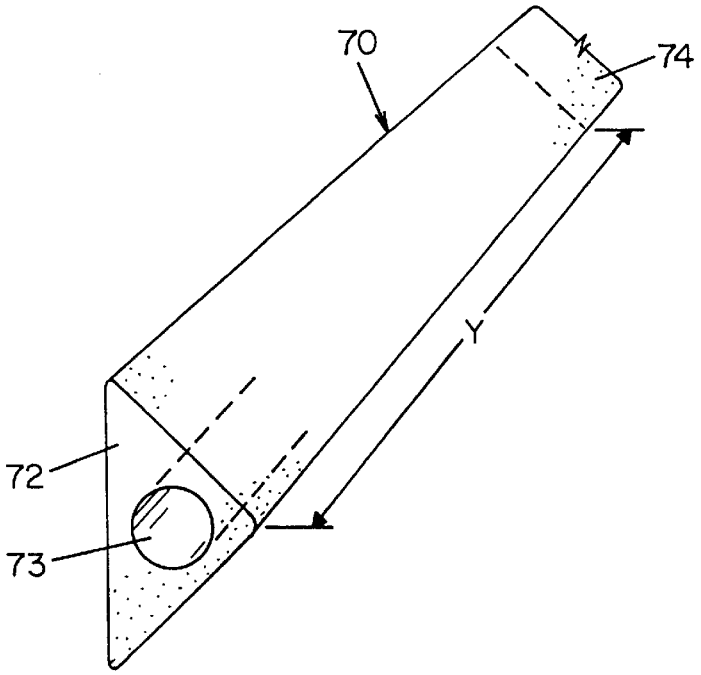
FIG. 6 is a perspective view of the molding material shown in FIGS. 3, 4 and 5.

In the preferred embodiment of FIGS. 1–6, resilient material 70 takes the form of a triangular shaped block 72 having a central, cylindrical opening 73 extending therethrough. Triangular block is dimensioned to nest within legs 49 of brace member 44. As best shown in FIG. 4, in the assembled position of plow 10, tubular block 72 extends beyond curved forward edge surfaces 50 to substantially fill gap X and contact moldboard rear surface 17. As best shown in FIG. 6, the exterior surfaces of triangular block 72 are straight. However, the length of triangular block 72 coupled with the flexible nature of resilient material 70 allow tubular block 72 to readily assume the vertical curvature of brace member 44. The length of tubular block 72 is greater than the vertical extending curved distance over which moldboard 18 flexes and that distance is indicated by reference letter Y in FIG. 6. Reference letter "Y" is used throughout the Detailed Description to mean the vertical length of resilient material 70 in gap X. The excess material or end portions 74 (only one end portion 74 shown in FIG. 6) is wedged between brace member 44 and top mounting leg 47 and between brace member 44 and flat bottom mounting plate 57. Central opening 73 is distended in end portions 74 when the plow is in its assembled position to positively assure that triangular block 72 is maintained in proper position. As best shown in FIG. 5, when a snow induced force indicated by the arrow is applied to front face 19 of moldboard 18, resilient material 70 expands into central opening 73 distorting or distending the opening as moldboard moves rearwardly. More specifically central opening 73 allows free compression of resilient material 70 so that moldboard 18 can freely flex or spring into gap X. At the same time, the triangular configuration of triangular block 72 allows its exterior surfaces to traverse gap X a greater distance than the span of brace member 44 to positively prevent debris and ice from somehow working their way into gap X between brace member 44 and moldboard 18.

The preferred embodiment of FIGS. 1–6 show triangular block 72 in contact with moldboard rearward surface 17 through vertical length Y of gap X. This is for drawing and illustration purposes only. In practice, triangular block 72 will not or may not nor is it necessary that triangular block member contact moldboard rear surface 19 throughout the vertical length Y of gap X.

Figure 4A:
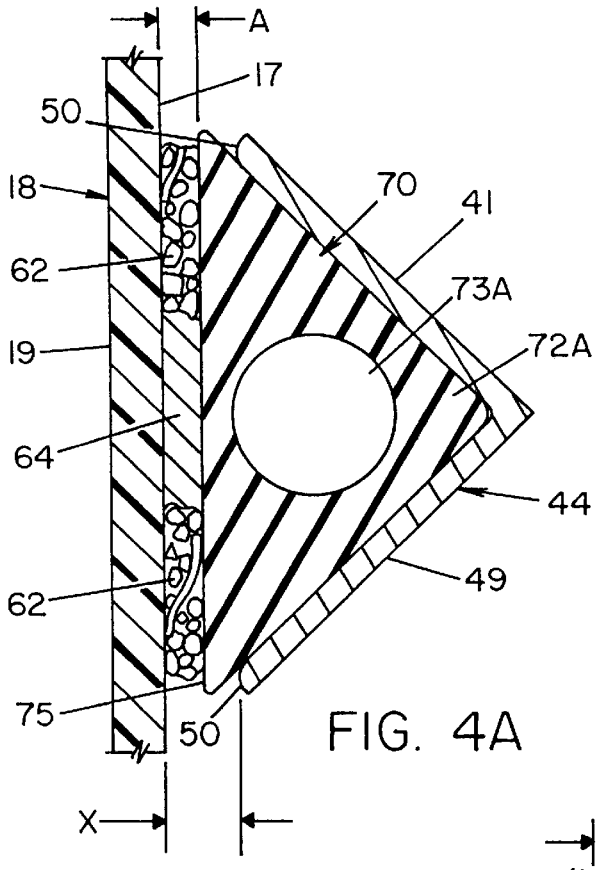
FIG. 4A is a view similar to FIG. 4 but showing an alternative arrangement of the molding material.
Figure 5A:
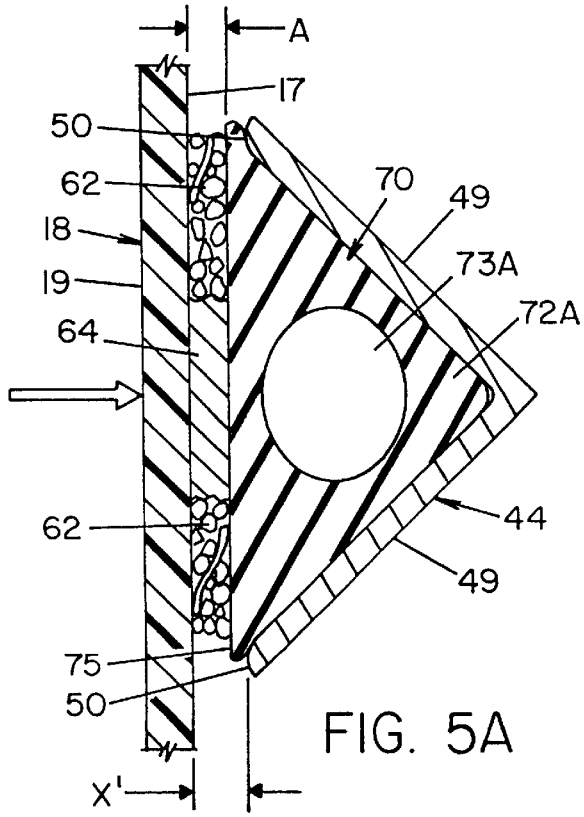
FIG. 5A is a view similar to FIG. 5 but showing the position of the molding material illustrated in FIG. 4A when the moldboard is deflected.

Reference may now be had to FIGS. 4A and 5A which illustrate an alternative embodiment of the invention and which correspond to FIGS. 4 and 5, respectively. Triangular block 72 is modified over its vertically extending, length dimension Y to have shorter exterior surface dimensions to produce modified block 72A having cylindrical central passageway 73A extending therethrough. End portions 74 of modified block 72A remain the same as triangular block 72 for purposes stated Because modified block 72A extends into gap X it reduces gap X to a distance indicated by dimension reference letter "A" in FIGS. 4A and 5A which is the distance between moldboard rear surface 17 and a confronting exterior surface 75 on modified block 72A. Within this reduced "assembled" gap shown as "A", foreign matter such as road debris indicated by reference numeral 62 and ice pockets indicated by reference numeral 64 accumulate. Gap X is thus reduced to zero by the protrusion of modified block 72A and foreign matter 62, 64. When a snow force shown by arrow in FIG. 5A is applied to front face 19 of moldboard 18, moldboard 18 is still able to resiliently flex and gap X is reduced to X' as shown. While reduced gap X' in FIG. 5A is greater than reduced gap X' shown in FIG. 5, the moldboard is still able to flex and in the process thereof enhance the rolling and transverse movement of snow over its face. Thus the invention is not necessarily limited to the requirement that the resilient material fill gap X because the moldboard will still spring in accordance with its designed objective if resilient material 70 only partially fills gap X as shown in FIGS. 4A and 5A. Of course, the resiliency of moldboard 18 is optimized if resilient material 70 substantially fills gap X.

Figure 7:
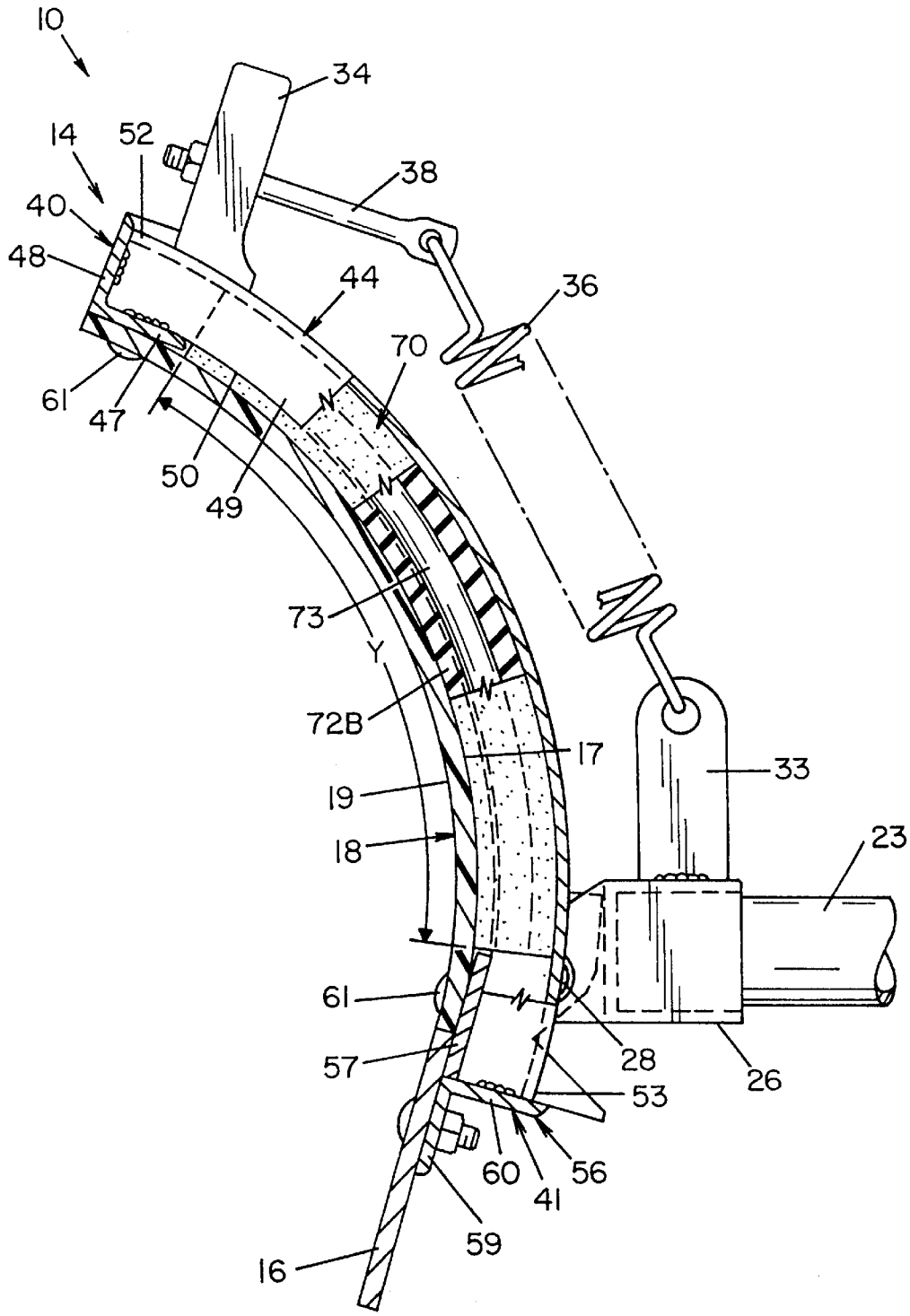
FIG. 7 is an end view of the plow similar to FIG. 3 but showing a different resilient material configuration.

Another modification to triangular block 72 is shown by triangular block 72B in FIG. 7. The additional modification is to remove end portions 74 of triangular block 72 which, as noted in the discussion of FIGS. 1–6, is wedged between brace member 44 and top mounting leg 47 and between brace member 44 and bottom mounting plate 57. Modified triangular block 72B thus extends only the distance Y as shown in FIG. 6. Legs 49 of brace member 44 retain modified triangular block 72B within brace member 44.

Figure 8:
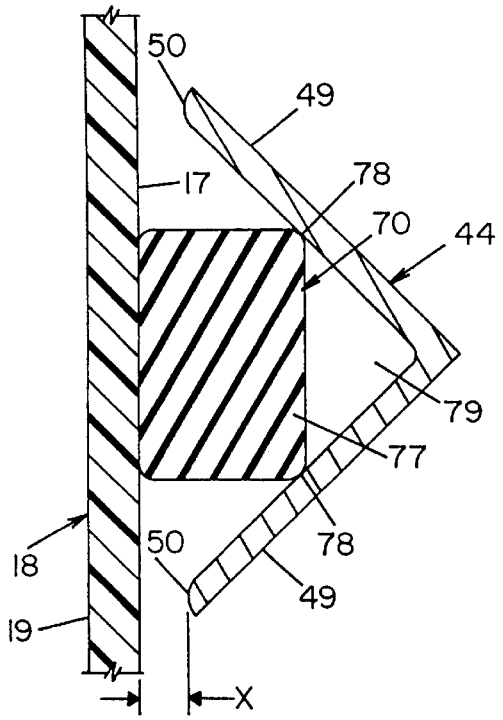
FIGS. 8 and 9 are views corresponding to FIGS. 4 and 5, respectively, but showing the cross-section configuration of the resilient material illustrated in FIG. 7.
Figure 9:
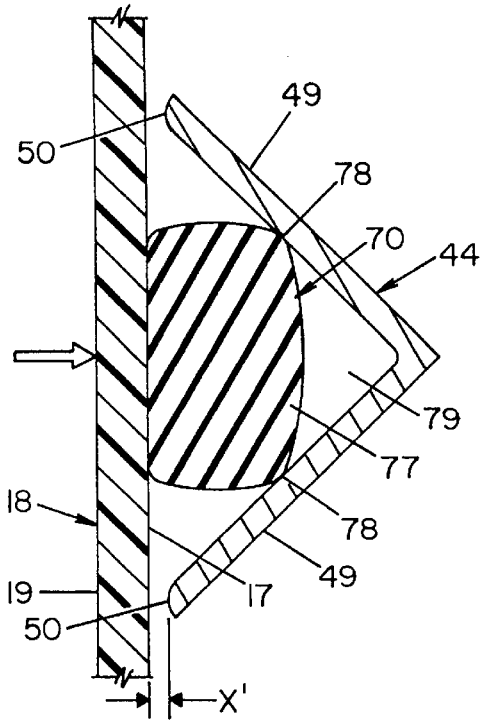
Figure 10:
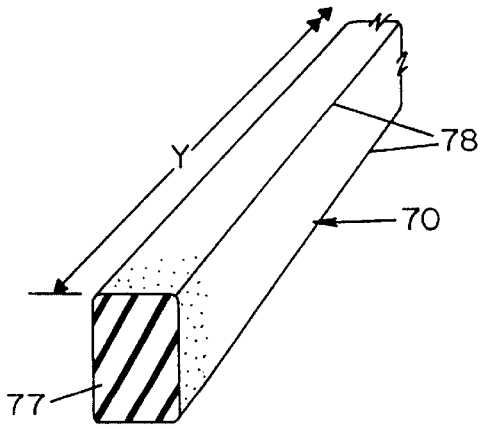
FIG. 10 is a perspective view of the resilient material shown in FIGS. 8 and 9.

Referring now to FIGS. 8, 9 and 10, an alternative configuration of resilient material 70 is shown to simply comprise a rectangular block of resilient material 70. Rectangular block 77 is dimensioned to extend a distance Y or alternatively could extend a greater distance to make contact with radially extending leg 48 of top mounting member 40 and bottom radially extending leg 60 of bottom mounting member 41 in the assembled position. The cross-section of rectangular block 77 is dimensioned so that its bottom width corners 78 contact V legs 49 of brace member 44 to leave a sealed apex space 79 between rectangular block 77 and brace member 44 into which foreign matter can not enter. Apex space 79 allows for deformation of resilient material 70 of rectangular block 77 when moldboard 18 flexes as shown in FIG. 9 notwithstanding the presence of any foreign matter between leg edge surface 50, moldboard 18 and rectangular block 77.

Figure 12:
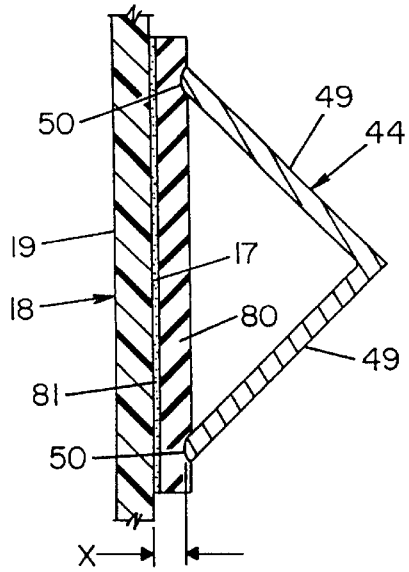
FIG. 12 is a cross-section view similar to FIGS. 4 and 8 taken along lines 12—12 of FIG. 11.
Figure 11:
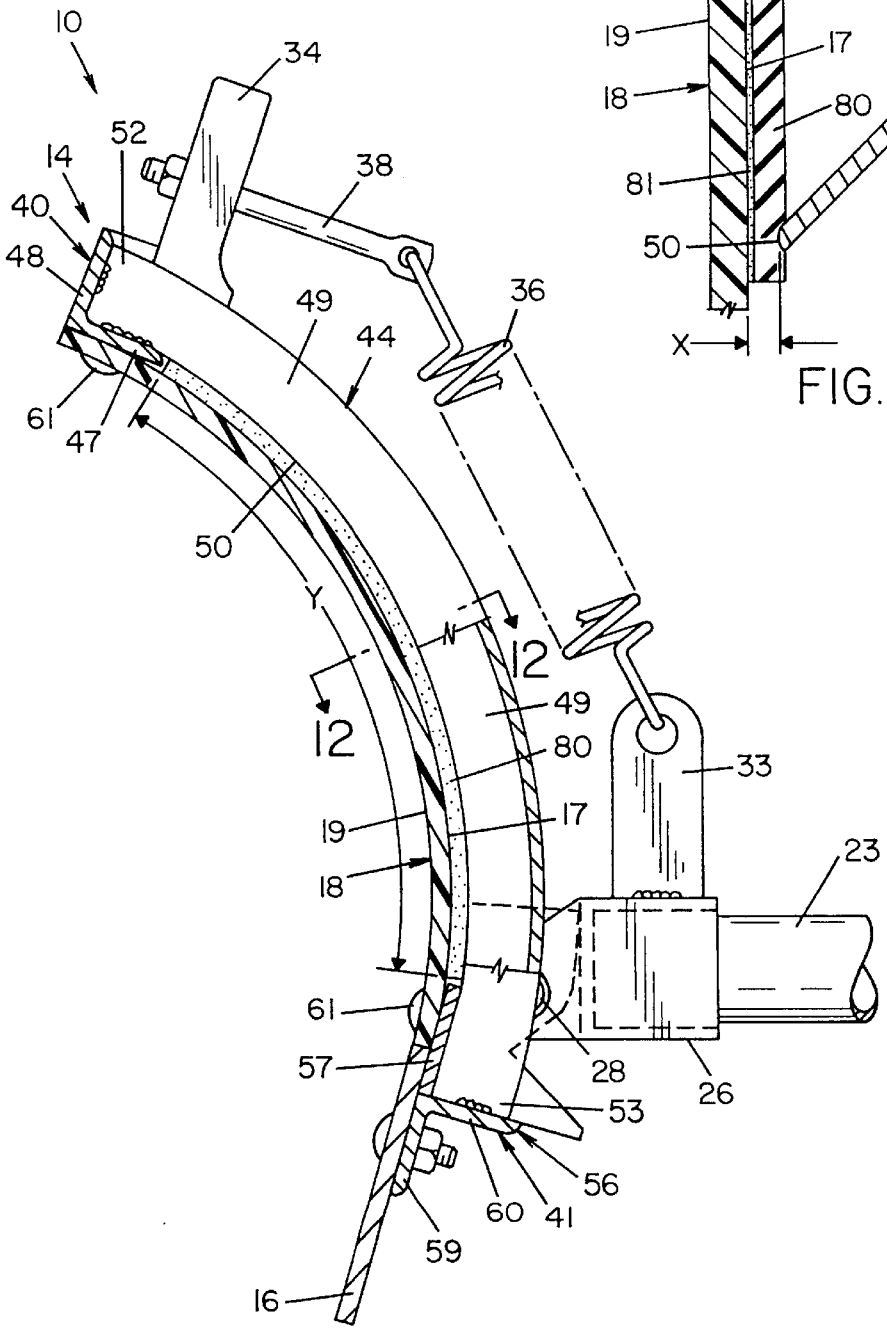
FIG. 11 is an end view of the plow similar to FIGS. 3 and 7 but showing a different resilient material configuration.

Referring next to FIGS. 11 and 12, there is shown a further alternative configuration of resilient material in the form of a resilient strip 80. Resilient strip 80 is secured to one side of a double, adhesive faced tape 81 which preferably has adhesive coated on both sides of a flexible or cushioned material. The other side of double faced tape 81 is secured to rearward surface 17 of moldboard 18. Preferably tape 81 and resilient strip 80 have a combined thickness slightly greater than gap X so that in the assembled position as shown in FIG. 12, forward curved edge surface 50 of brace member 44 firmly contacts strip 80. Double faced tape 81 functions to properly position resilient strip 80 for assembly of moldboard 18 into frame 14. Depending on assembly techniques, double faced adhesive tape 81 could be eliminated in lieu of other assembly techniques. Alternatively, the resilient material of double faced adhesive tape 81 could comprise solely the resilient material 70 and specially purchased cushioned tape 81 (adhesive coated on one side only) could replace resilient strip 80. Still further, resilient strip 80 could simply be coated with adhesive for attachment to moldboard rearward surface 17. As best shown in FIG. 11, the length Y of resilient strip 80 can not be greater than the distance between the exposed edge of top mounting leg 47 and the exposed edge of bottom mounting plate 57.

Figure 13:
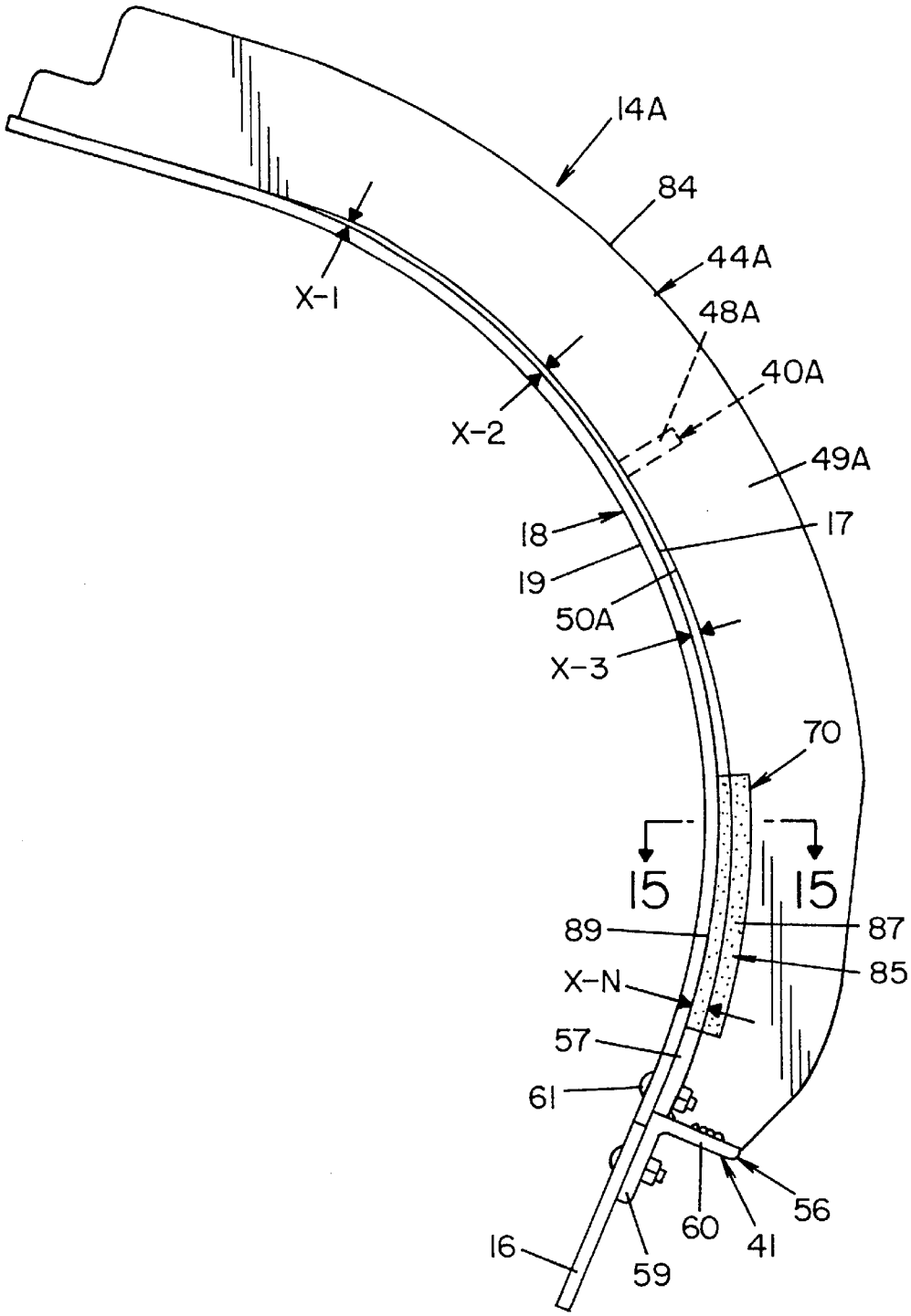
FIG. 13 is an end view similar to FIGS. 3, 7 and 11 but showing a different brace member and a different frame than that shown in FIGS. 1–12.

Another embodiment of the invention is illustrated in FIGS. 13–17. Frame 14A shown in FIGS. 13 and 14 has a different configuration than frame 14 illustrated in FIGS. 1–12 but is fundamentally the same as that previously described so reference numerals used to describe frame 14 in FIGS. 1–3 will apply, where applicable, to frame 14 illustrated in FIGS. 13 and 14. Brace member 44A is not in the shape of a V but simply in the form of a flat plate which then comprises a single leg 49A having a forward edge curved surface 50A. Brace member 44A is secured to bottom mounting member 41 comprising bottom angle 56 and flat bottom mounting plate 57 as described. Top mounting member 40A (now in the form of segments between adjacent brace members 44A) is positioned approximately midway the length of brace member 44A and its and radially extending leg 48A are welded to leg 49A of brace member 44A as at reference numeral 83 best shown in FIG. 14. Brace member 44A thus differs from brace member 44 previously described by having a top extension portion 84 protruding beyond radially extending leg 48A. More significantly, brace member 44A differs from brace member 44 described with reference to FIGS. 1–12 in that forward edge curved surface 50A is configured to form a progressively changing gap X with rearward surface 17 of moldboard 18. This is best shown in FIG. 13 by gap dimensions X–1, X–2, X–3 . . . X-N which progressively vary from the top of moldboard 18 to its bottom. Preferably gap dimensions vary to produce a gap in the form of a partial crescent (moon shaped) although other configurations are possible. The progressive gap X is intentionally designed into the assembled configuration so that moldboard 18 has little spring or flex at its top portion and significantly greater flex at its bottom, transversely extending portion. This intentionally designed gap enhances the ability of the plow to roll the snow into the curvature of moldboard 18. Progressive gap is conventional. It is not, per se, part of this invention. This invention assures that progressive gap X functions for its designed purpose. It should also be noted that gap X, intentionally (as in this embodiment) or not (as in the embodiments illustrated in FIGS. 1–12) is not uniform because of dimensional variations, assembly procedures, etc.

Figure 14:
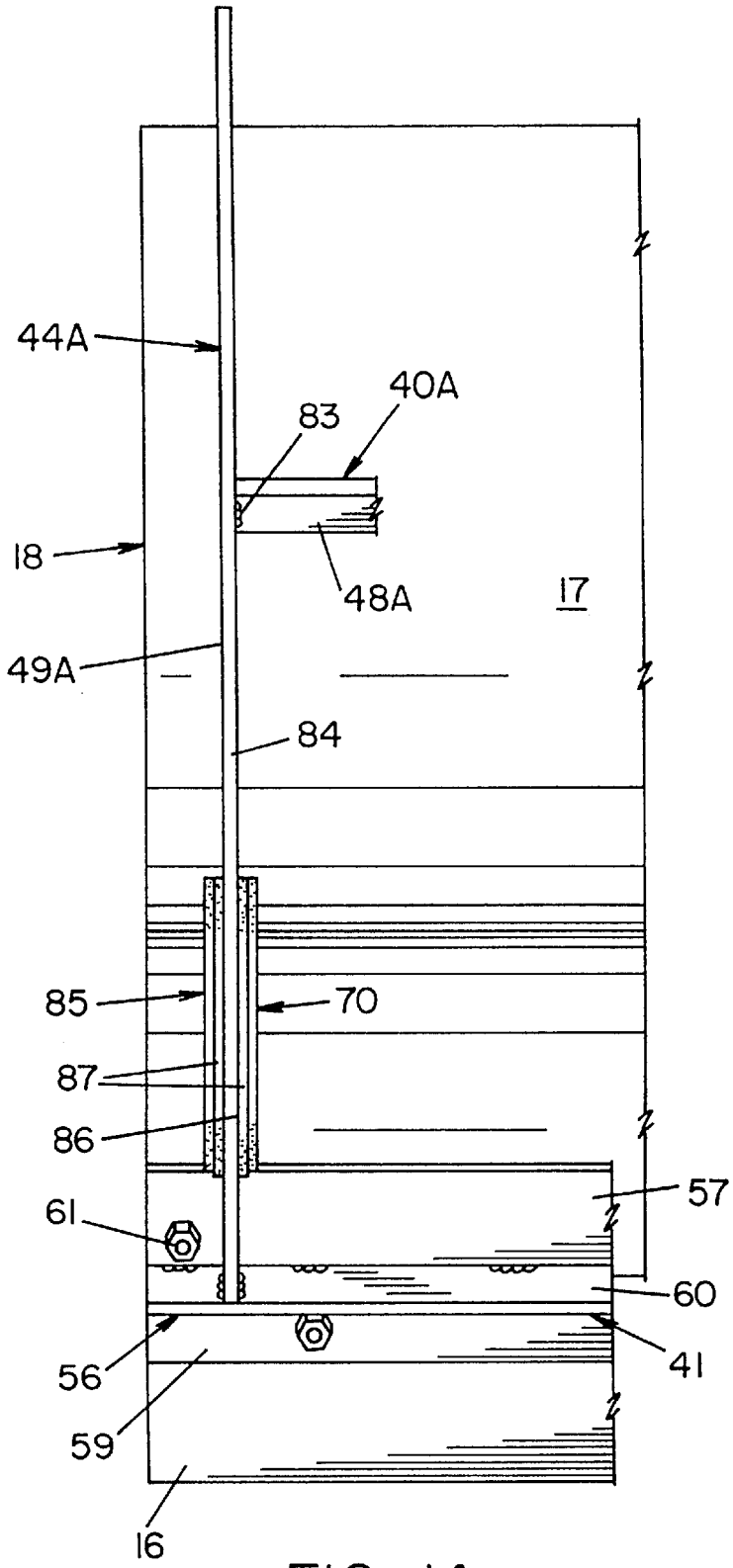
FIG. 14 is a view similar to FIG. 2 but showing the brace member illustrated in FIG. 13.
Figure 15:
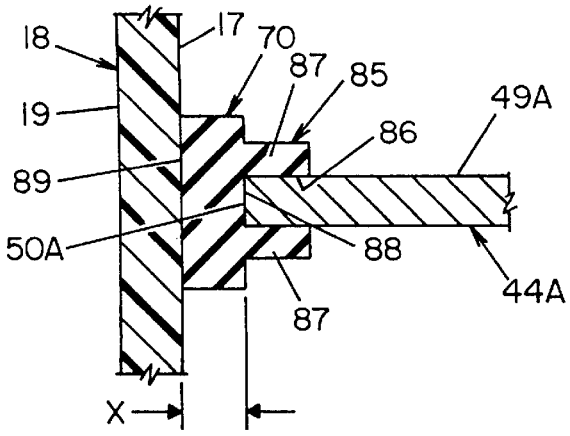
FIG. 15 is a cross-sectional view similar to FIGS. 4, 8 and 12 taken along lines 15—15 of FIG. 13, but showing a cross-section of the resilient material used with the brace member shown in FIGS. 13 and 14.
Figure 16:
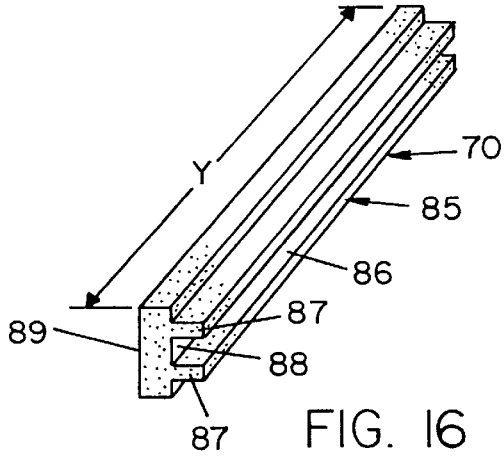
FIG. 16 is a perspective view of the resilient material shown in FIG. 15.

In the embodiment of the invention illustrated in FIGS. 13–17, resilient material 70 takes the form of a channel strip 85 having a longitudinally extending groove or channel 86 formed in one of its sides. Channel 86 has side walls 87 receiving leg 49A of brace member 44A and a bottom surface 88 in contact with forward curved edge surface 50A of brace member 44A. Channel strip 85 may and is preferably dimensioned so that the distance between an exterior channel strip surface 89 which confronts rear surface 17 of moldboard 18 and bottom surface 88 is progressively varied to equal gap X. Importantly the length of channel strip 85 in gap X shown as dimension Y in FIG. 16 need not equal the vertical length of moldboard 18 as in the configurations previously discussed. As discussed above, forming gap X as a progressive gap is to insure flex of moldboard 18 over its bottom transversely extending portion. Accordingly, channel strip 85 need only extend over the bottom transversely portion of brace member 44A to insure flex of moldboard 18 at that moldboard portion as best shown in FIGS. 13 and 14. Accumulation of foreign material into that portion of gap X not occupied partially or wholly by resilient material 70 will not adversely affect the operation of plow 10 for its designed purpose.

Figure 17:
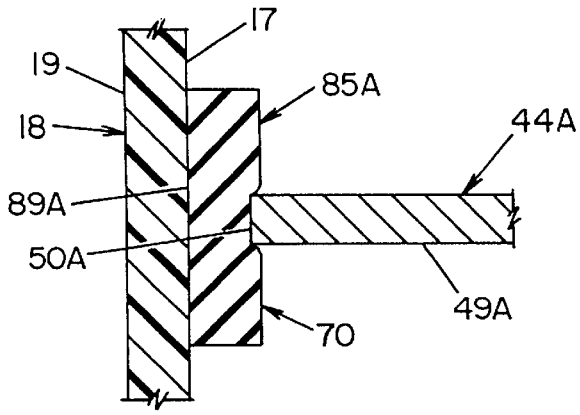
FIG. 17 is a view similar to FIG. 15 but showing a modification of the configuration of the resilient material used with the brace member shown in FIGS. 13 and 14.

FIG. 17 illustrates a modification of channel strip 85 suggested by the embodiment illustrated and described with reference to FIGS. 11 and 12. Channel strip 85A is modified in FIG. 17 to remove channel 86. Channel strip 85A can be affixed to rearward surface 17 of moldboard 18 by means of double faced adhesive tape 81 (not shown) or by adhesive coated to exterior surface 89A.

Figure 18:
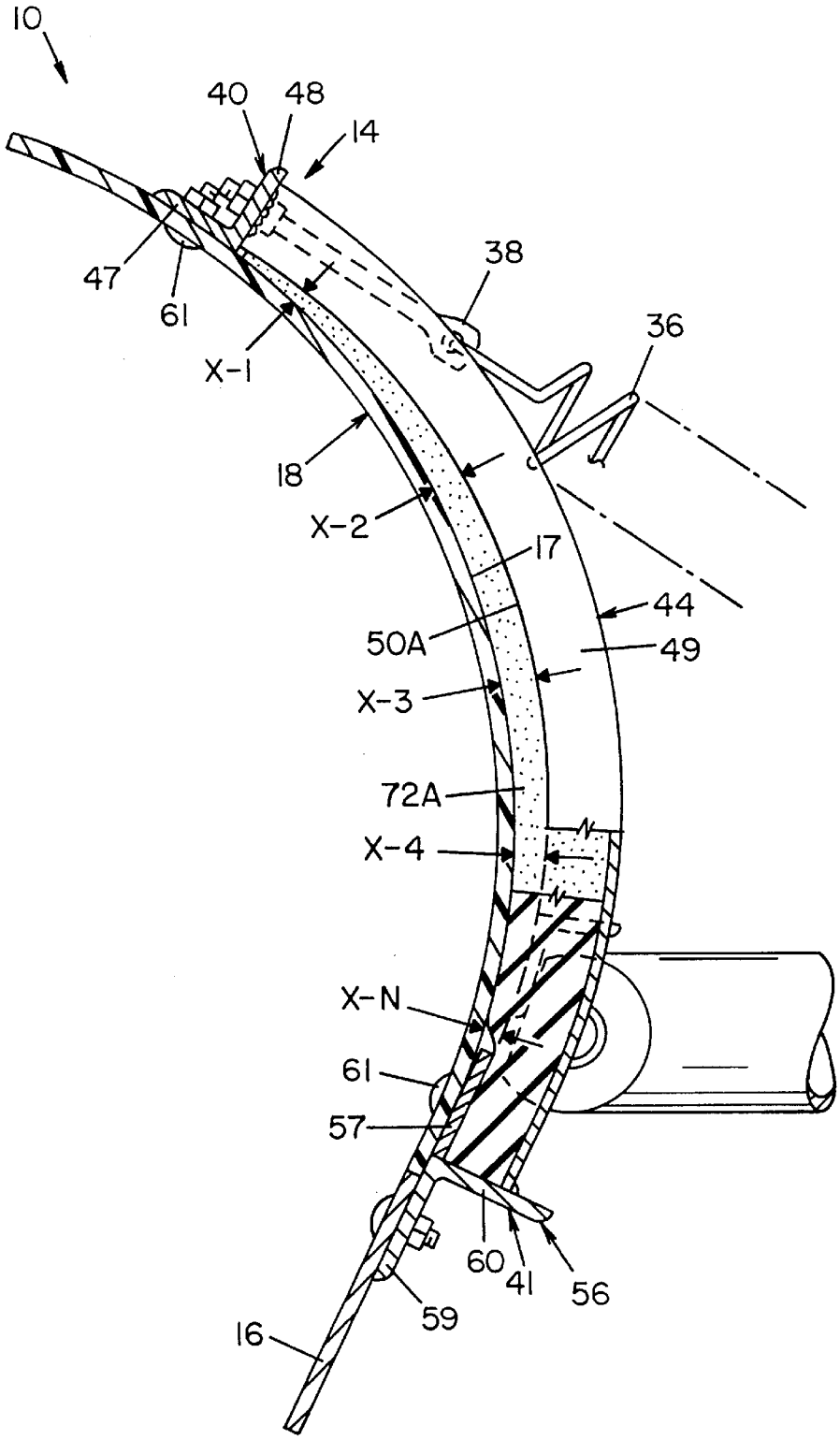
FIG. 18 is an end view similar to FIGS. 3, 7, 11 and 13 but showing a different gap between the moldboard and brace member.
Figure 19:
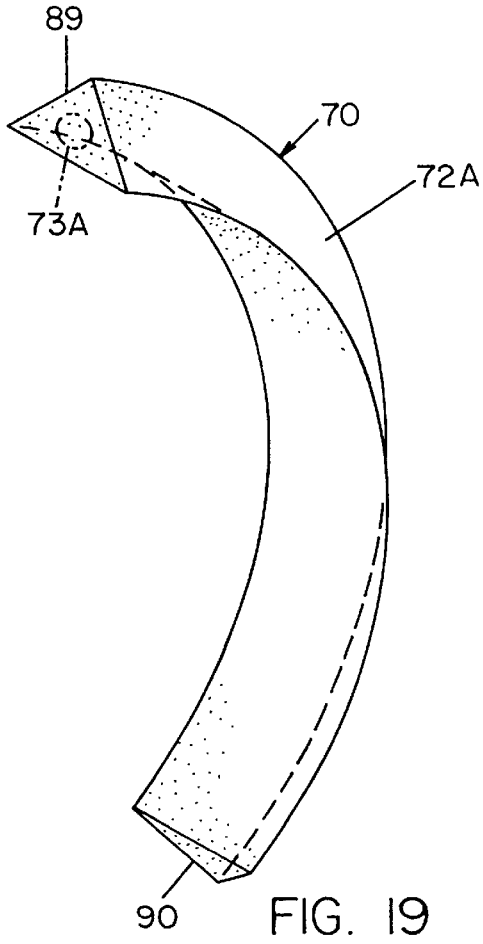
FIG. 19 is a perspective view of the resilient material used to fill the gap illustrated in FIG. 18.

Referring now to FIGS. 18 and 19, there is shown the varying gap X described with reference to frame 14A in FIGS. 13 and 14 but applied to a frame 14 of the type shown in FIGS. 1–12. The frame in FIG. 18 is identical to frame 14 of FIGS. 1–12 with the exception that top mounting member 40 has its mounting leg 47 extending vertically upward instead of vertically downward as shown in FIGS. 1–12. This is only for the purpose of illustrating a variation in frame 14. It is not necessary to change the orientation of top mounting member 40 to apply a resilient material to an intentionally designed varying gap X such as shown in FIGS. 13. FIG. 18 is disclosed to simply illustrate that inwardly curved, forward edge surface 50A of brace member 44 can be shaped to provide a varying gap X as shown in FIG. 18. Triangular block 72A as shown in FIG. 19 has a height which preferably diminishes from a top end 89 to a bottom end 90 to match the progressive change in gap X. While this dimensional relationship is preferred, it is not necessary for the invention to function as demonstrated in FIGS. 4A and 5A and the height of triangular block 72A could be constant. As shown in FIG. 19, triangular block may be provided with a central opening 73A extending therethrough.

Figure 20A:
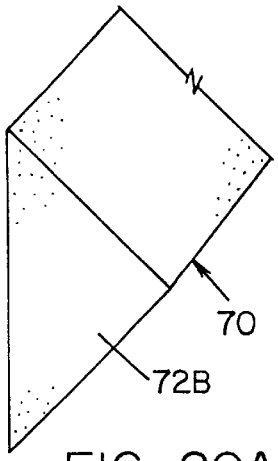
FIGS. 20A, 20B, 20C and 20D are perspective views of different shapes of resilient material configurations that can be applied in the gap between the moldboard and the bottom edge of the brace member.
Figure 20B:
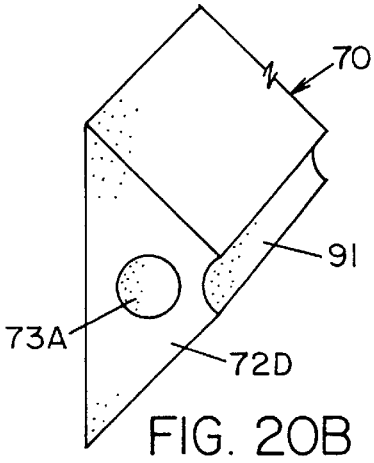
Figure 20C:
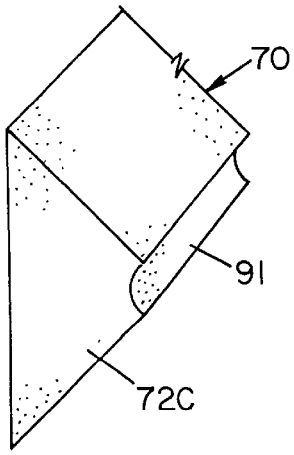
Figure 20D:
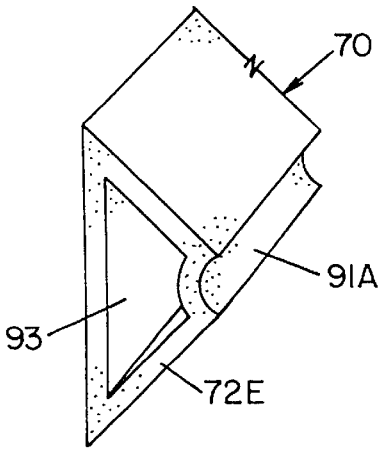

Alternative configurations of resilient material 70 making up variations of triangular block 72 are illustrated in FIGS. 20A, 20B, 20C and 20D. In FIG. 20A, a solid triangular block 72B is shown. When moldboard 18 flexes, resilient material will spread from each side of brace member 44 as the resilient material distends beyond forward curved edge surface 50. In FIG. 20C, solid triangular block 72C has a semi-circular groove 91 formed at an apex thereof extending the length thereof. Groove 91 fits within V tip of legs 49 of brace member 44 to form a sealed apex expansion area for resilient material 70 similar to that shown by reference numeral 79 in the embodiments illustrated in FIGS. 8 and 9. In FIG. 20B triangular blocks 72A and 72C are combined to form triangular block 72D. In Figure 20D, a triangular block 72E is shown having a triangular shaped central passage 93 formed by making the exterior surfaces of triangular block 72E into generally equally thick wall sections. Passage 93 is not completely triangular in configuration because of the optional addition of semi-circular groove 91A at the apex thereof as discussed with respect to FIG. 20C which causes the formation of a semi-circular wall section forming part of passage 93. The selection of any specific configuration depends on several factors including the dimensioning of the resilient mass configuration and the properties of the resilient material selected. The resilient material should not have a hardness or a stiffness that prevents moldboard 18 from flexing and preferably permits moldboard 18 to flex to the same or as close to the same extent that moldboard 18 would flex if gap X were free of foreign material. At the same time resilient material 70 must have sufficient rigidity preventing accumulation of foreign material in gap X or in gap X to the extent that foreign matter fills gap X. The configuration of the mass of resilient material, as shown by the several embodiments disclosed has to be designed in accordance with such considerations.

Figure 23A:
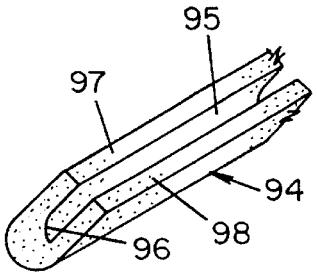
FIG. 23A is a perspective view of the resilient material shown in FIG. 23.
Figure 23:
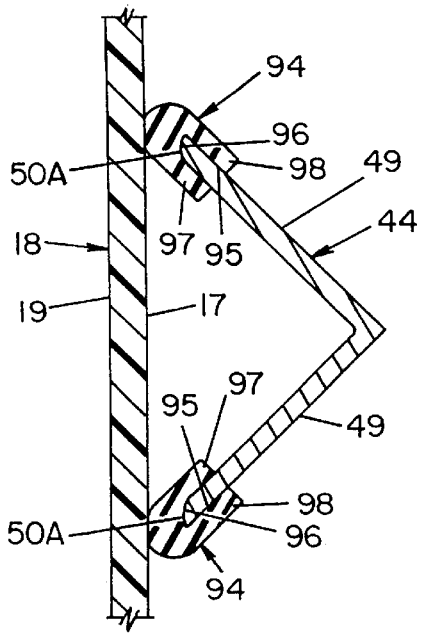
FIG. 23 is a view similar to FIGS. 4, 4A, 8, 12, 15 and 17 but showing a different configuration of resilient material.

Retrofit applications of the invention are disclosed in embodiments illustrated in FIGS. 23 and 23A, 24 and 24A and 25. In FIGS. 23 and 23A there is disclosed a resilient insert 94 which is U shaped and has a longitudinally extending groove 95 formed at the top thereof with the base of the "U" contacting moldboard 18 or alternatively filling at least a portion of gap X. As noted above, in the preferred embodiment, brace member 44 is a structural angle with forward edge surfaces 50 cut inwardly to a desired curvature. As shown in FIG. 23, forward edges surface 50A of each leg 49 of brace member is also cut with a chamfer as shown. This chamfer matches a bottom surface 96 formed in groove 95 of resilient insert 94. This configuration allows for sidewalls 97, 98 of groove 95 to be spread open so that resilient insert 94 can be snapped onto leg 49 of brace member 44. The base of U shaped resilient insert 94 is then pushed against moldboard rear surface 17 to cause groove bottom surface 96 to lockingly seat against forward edge surface 50A of leg 49.

Figure 24A:
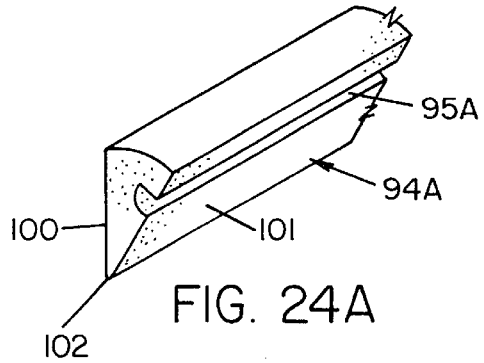
FIG. 24A is a perspective view of the resilient material shown in FIG. 24.
Figure 24:
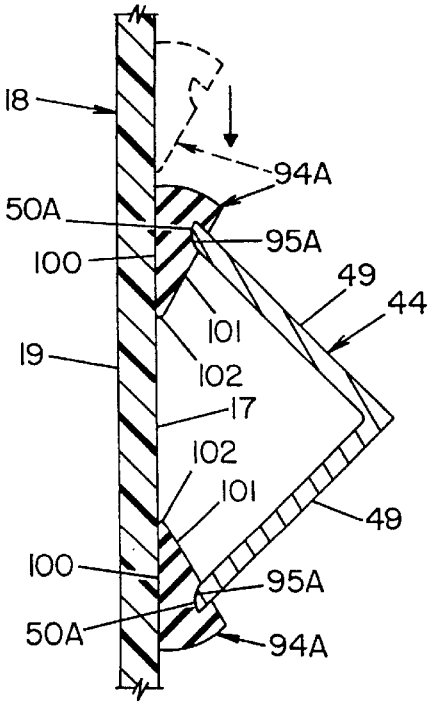
FIG. 24 is a view similar to FIGS. 4, 4A, 8, 12, 15, 17 and 23 but showing a different configuration of resilient material.

A different retrofit resilient insert 94A is illustrated in FIGS. 24 and 24A. Resilient insert 94A has two tapering external surfaces 100, 101 joined together at apex 102 to form a wedge shaped resilient insert. One external surface, 100, confronts rear moldboard surface 17 and the other external surface, 101, contains groove 95A configured in the manner described for resilient insert 94 shown in FIGS. 23 and 23A. The wedge shape of resilient insert 94A permits relatively easy retrofit application. It is to be understood that either resilient insert 94 or 94A is not limited to retrofit application and can be utilized as the resilient material for new plows.

Figure 25:
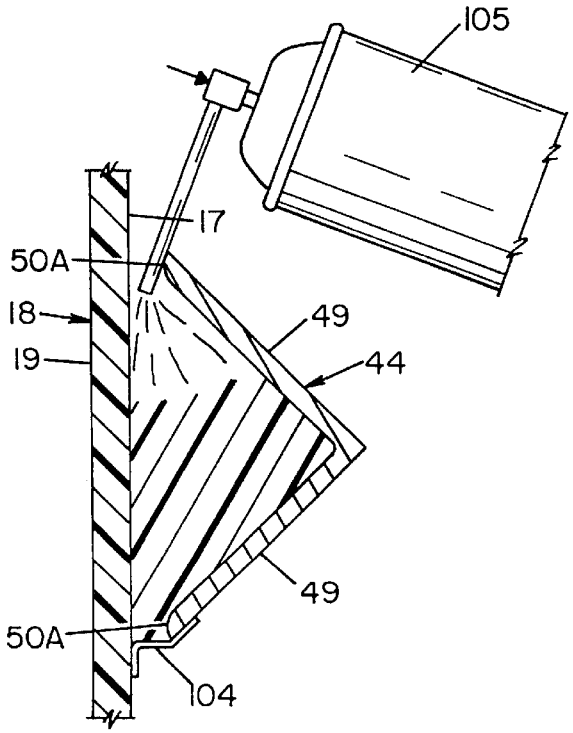
FIG. 25 is a view similar to FIGS. 4, 4A, 8, 12, 15, 17, 23 and 24 but showing a different type of resilient material and illustrating a method of applying the different type of resilient material.

FIG. 25 illustrates yet another embodiment of the invention falling within the definition of resilient material set forth above. In this embodiment which is particularly suited for brace members 44 having a structural angle configuration a removable clip 104 or other suitable sheet or brace is provided to temporarily close gap X at one side of brace member 44 while an expandable polymeric foam is injected into the interior of brace member 44 from a foam container 105 at the other side of brace member 44. As is well known, the contents of the foam which are released as liquids from pressurized container 105 expand when exposed to moisture from the air into a foam which completely fills the interior of brace member 44. An open cell or flexible foam is used so that the foam has the resilience desired to expand and contract. The degree of flexibility that the foam has is a function of its composition. Conventional one component or two component flexible polyurethane foams may be utilized.

The invention has been described with reference to a number of embodiments. Obviously, alterations and modifications will occur to others upon reading and understanding the detailed description of the invention set forth herein. For example and by way of illustration and not limitation, the invention has been primarily described as a mechanism which permits the designed gap X to function for its intended purpose. The design of the moldboard has not been described in any detail except to note that the moldboard flexes and that the flex is controlled over select portions of the moldboard by the size (and inherently the position) of gap X. It is within the broader concepts of the invention that the resilient material and the design of the moldboard can be combined to produce desired flexing of the moldboard and desired flexing over select portions of the moldboard. Thus it is within the invention to size any of the resilient molding configurations described herein to extend beyond (as well as within) the gap X or to variably extend beyond the gap or to vary the composition of the resilient material within any of the "blocks" of material disclosed for various portions of the "block" whereby foreign material is not only prevented from accumulating in the gap but a desired moldboard flexing action results. Further modifications may be to construct brace member 44 as "L" shape or channel shape or H beam shape or to fabricate the brace member in any number of configurations. It is intended to include all such modifications within the scope of the present invention.

Having thus defined the invention, it is claimed:

1. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap.

2. The vehicle plow as defined in claim 1, wherein said resilient material is fully positioned in said gap.

3. The vehicle plow as defined in claim 2, wherein said resilient material has a thickness at least about equal to the thickness of said gap.

4. The vehicle plow as defined in claim 1, wherein said resilient material is at least partially positioned outside said gap.

5. The vehicle plow as defined in claim 4, wherein said resilient material has a thickness that is less than the thickness of said gap.

6. The vehicle plow as defined in claim 4, wherein said resilient material has a thickness at least about equal to the thickness of said gap.

7. The vehicle plow as defined in claim 1, herein said resilient material fully fills said gap.

8. The vehicle plow as defined in claim 2, herein said resilient material fully fills said gap.

9. The vehicle plow as defined in claim 2, wherein said resilient material has a thickness that is less than the thickness of said gap.

10. The vehicle plow as defined in claim 4, herein said resilient material fully fills said gap.

11. The vehicle plow as defined in claim 1, wherein said resilient material has a thickness that is less than the thickness of said gap.

12. The vehicle plow as defined in claim 1, wherein said resilient material has a thickness at least about equal to the thickness of said gap.

13. The vehicle plow as defined in claim 1, wherein said resilient material is at least partially compressible.

14. The vehicle plow as defined in claim 1, wherein said rigid frame includes top and bottom longitudinally mounting members vertically spaced from one another by a plurality of said brace members transversely spaced along the length of said mounting members, said plow blade connected to said mounting members when assembled into said frame.

15. The vehicle plow as defined in claim 14, wherein at least one of said brace members is a substantially flat plate defined as a single leg having two edges, said resilient material being interposed between at least one of said two edges and said plow blade.

16. The vehicle plow as defined in claim 14, wherein at least one of said brace members is in the form an L shaped plate.

17. The vehicle plow as defined in claim 14, wherein said plow blade and a confronting portion of said brace member are at least partially inwardly curved to define said gap as an at least partially arcuate gap.

18. The vehicle plow as defined in claim 17, wherein at least one of said brace members is a substantially flat plate defined as a single leg having two edges, said resilient material being interposed between at least one of said two edges and said plow blade.

19. The vehicle plow as defined in claim 17, wherein at least one of said brace members is in the form an L shaped plate.

20. The vehicle plow as defined in claim 14, wherein at least one of said brace members are structural angle members, said at least one brace member having two legs that form a V-shaped cross-sectional brace member configuration.

21. The vehicle plow as defined in claim 20, wherein said resilient material extends beyond said leg edges to substantially close a space between said leg edge and said plow blade.

22. The vehicle plow as defined in claim 17, wherein at least one of said brace members are structural angle members, said at least one brace member having two legs that form a V-shaped cross-sectional brace member configuration.

23. The vehicle plow as defined in claim 22, wherein the edges of said legs being at least partially inwardly curved, said leg edges and the back of said plow blade defining said gap as an arcuate gap.

24. The vehicle plow as defined in claim 1, wherein said plow blade and a confronting portion of said brace member are at least partially inwardly curved to define said gap as an at least partially arcuate gap.

25. The vehicle plow as defined in claim 1, including a damping material at least partially positioned in said gap.

26. The vehicle plow as defined in claim 25, wherein said damping material includes said resilient material.

27. The vehicle plow as defined in claim 1, wherein said plow blade is a plastic moldboard.

28. The vehicle plow as defined in claim 27, wherein said plastic moldboard includes polyethylene.

29. The vehicle plow as defined in claim 1, wherein said plow blade includes a scrapper which is attached to the base of said plow blade.

30. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame said rigid frame, including at least one vertically extending brace member which forms a gap between the brace member and said plow blade, said resilient material at least partially positioned in said gap, said resilient material has a thickness at least about equal to the thickness of said gap, said resilient material has a thickness greater than the thickness of said gap and is at least partially compressed in said gap.

31. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material is fully positioned in said gap, said resilient material has a thickness at least about equal to the thickness of said gap, said resilient material has a thickness greater than the thickness of said gap and is at least partially compressed in said gap.

32. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material is fully positioned in said gap, said resilient material has a thickness at least about equal to the thickness of said gap, said resilient material has a thickness greater than the thickness of said gap and is at least partially compressed in said gap.

33. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material fully fills said gap, said resilient material has a thickness greater than the thickness of said gap and is at least partially compressed in said gap.

34. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material includes an adhesive material to at least partially secure said resilient material in said gap.

35. The vehicle plow as defined in claim 34, wherein said adhesive material includes a tape with adhesive on both sides of the tape, the adhesive on one side of said tape at least partially secures said tape to said resilient material, the adhesive on the other side of said tape at least partially secures said resilient material in said gap.

36. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rapid frame including at least one vertically extending brace member which forms a gap between the brace member and said plow blade, said resilient material at least partially positioned in said gap, said resilient material is fully positioned in said gap, said resilient material includes an adhesive material to at least partially secure said resilient material in said gap.

37. The vehicle plow as defined in claim 36, wherein said adhesive material includes a tape with adhesive on both sides of the tape, the adhesive on one side of said tape at least partially secures said tape to said resilient material, the adhesive on the other side of said tape at least partially secures said resilient material in said gap.

38. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material is at least partially positioned outside said gap, said resilient material includes an adhesive material to at least partially secure said resilient material in said gap.

39. The vehicle plow as defined in claim 38, wherein said adhesive material includes a tape with adhesive on both sides of the tape, the adhesive on one side of said tape at least partially secures said tape to said resilient material, the adhesive on the other side of said tape at least partially secures said resilient material in said gap.

40. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material fully fills said gap, said resilient material includes an adhesive material to at least partially secure said resilient material in said gap.

41. The vehicle plow as defined in claim 40, wherein said adhesive material includes a tape with adhesive on both sides of the tape, the adhesive on one side of said tape at least partially secures said tape to said resilient material, the adhesive on the other side of said tape at least partially secures said resilient material in said gap.

42. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material has a thickness that is less than the thickness of said gap, said resilient material includes an adhesive material to at least partially secure said resilient material in said gap.

43. The vehicle plow as defined in claim 42, wherein said adhesive material includes a tape with adhesive on both sides of the tape, the adhesive on one side of said tape at least partially secures said tape to said resilient material, the adhesive on the other side of said tape at least partially secures said resilient material in said gap.

44. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material includes a block of material, said block material including a cross-sectional shape selected from the group consisting of a circle, an oval, a triangle, and a polygon.

45. The vehicle plow as defined in claim 44, wherein said resilient material includes a block of material, said block of material including at least one groove formed on at least one side of said block of resilient material.

46. The vehicle plow as defined in claim 45, wherein said block of material having an opening that at least partially extends through said block of material.

47. The vehicle plow as defined in claim 46, wherein said resilient material is at least partially compressible.

48. The vehicle plow as defined in claim 47, wherein said opening distorts when said resilient material is compressed.

49. The vehicle plow as defined in claim 47, wherein said groove distorts when said resilient material is compressed.

50. The vehicle plow as defined in claim 45, wherein said resilient material is at least partially compressible.

51. The vehicle plow as defined in claim 50, wherein said groove distorts when said resilient material is compressed.

52. The vehicle plow as defined in claims 44, wherein said block of material having an opening that at least partially extends through said block of material.

53. The vehicle plow as defined in claim 52, wherein said resilient material is at least partially compressible.

54. The vehicle plow as defined in claim 53, wherein said opening distorts when said resilient material is compressed.

55. The vehicle plow as defined in claim 44, wherein said resilient material is at least partially compressible.

56. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material includes a polymeric foam.

57. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said resilient material includes a rubber based material, said rubber based material having a Durometer hardness of about 30 to about 80.

58. The vehicle plow as defined in claim 57, wherein said Durometer hardness of said rubber based material about 40 to about 60.

59. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said rigid frame includes top and bottom longitudinally mounting members vertically spaced from one another by a plurality of said brace members transversely spaced along the length of said mounting members, said plow blade connected to said mounting members when assembled into said frame, at least one of said brace members are structural angle members, said at least one brace member having two legs that form a V-shaped cross-sectional brace member configuration, said resilient material includes a V-shaped portion to fit between said V-shaped cross-sectional brace member and said plow blade.

60. The vehicle plow as defined in claim 59, wherein said resilient material extends beyond said leg edges to substantially close a space between said leg edge and said plow blade.

61. A vehicular plow of the type used to clear snow and like debris from roadways and similar surfaces comprising:

a plow blade, a rigid frame adapted to be secured to a vehicle on one side thereof and to which said plow blade is assembled on the opposite side thereof, a resilient material at least partially positioned between said plow blade and said rigid frame, said rigid frame including at least one vertically extending brace member which forms a gap between the brace member and said plow blade, said resilient material at least partially positioned in said gap, said rigid frame includes top and bottom longitudinally mounting members vertically spaced from one another by a plurality of said brace members transversely spaced along the length of said mounting members, said plow blade connected to said mounting members when assembled into said frame, said plow blade and a confronting portion of said brace member are at least partially inwardly curved to define said gap as an at least partially arcuate gap, at least one of said brace members are structural angle members said at least one brace member having two legs that form a V-shaped cross-sectional brace member configuration, the edges of said legs being at least partially inwardly curved, said leg edges and the back of said plow blade defining said gap as an arcuate gap, said resilient material includes a V-shaped portion to fit between said V-shaped cross-sectional brace member and said plow blade.

62. The vehicle plow as defined in claim 61, wherein said resilient material extends beyond said leg edges to substantially close a space between said leg edge and said plow blade.

* * * * *